US011427378B2

(12) United States Patent
Schultz et al.

(10) Patent No.: US 11,427,378 B2
(45) **Date of Patent: *Aug. 30, 2022**

(54) EYE SHIELD DISPENSER

(71) Applicant: TIDI Products, LLC, Neenah, WI (US)

(72) Inventors: Bradly Thomas Schultz, Greenville, WI (US); Brian Wilt, Appleton, WI (US); Katie Umentum, DePere, WI (US); Rob Sweitzer, Apex, NC (US)

(73) Assignee: TIDI Products, LLC, Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/889,740

(22) Filed: Jun. 1, 2020

(65) Prior Publication Data

US 2020/0317391 A1 Oct. 8, 2020

Related U.S. Application Data

(63) Continuation-in-part of application No. 16/118,809, filed on Aug. 31, 2018, now Pat. No. 10,669,062, which is a continuation of application No. 14/264,206, filed on Apr. 29, 2014, now Pat. No. 10,065,762, application No. 16/889,740, which is a continuation-in-part of application No. 16/248,258, filed on Jan. 15, 2019, now abandoned, which is a continuation of application No. 14/213,416, filed on Mar. 14, 2014, now Pat. No. 10,179,671.

(60) Provisional application No. 61/817,403, filed on Apr. 30, 2013, provisional application No. 61/792,371, filed on Mar. 15, 2013.

(51) Int. Cl.

| | |
|---|---|
| ***B65D 5/72*** | (2006.01) |
| ***B65D 5/02*** | (2006.01) |
| ***B65D 5/42*** | (2006.01) |

(52) U.S. Cl.

CPC ..... *B65D 5/725* (2013.01); *B65D 5/029* (2013.01); *B65D 5/0245* (2013.01); *B65D 5/0254* (2013.01); *B65D 5/4204* (2013.01)

(58) Field of Classification Search

CPC ..... B65D 5/724; B65D 5/725
USPC ..... 206/5; 220/480, 481; 229/122.1
See application file for complete search history.

(56) References Cited

U.S. PATENT DOCUMENTS

| | | | |
|---|---|---|---|
| 3,207,380 | A | 9/1965 | Hennessey |
| 3,265,283 | A | 8/1966 | Farquhar |

(Continued)

FOREIGN PATENT DOCUMENTS

GB 2347669 A * 9/2000 ..... B65D 5/4208

*Primary Examiner* — Nathan J Newhouse
*Assistant Examiner* — Phillip D Schmidt
(74) *Attorney, Agent, or Firm* — Davis & Kuelthau, s.c.

(57) ABSTRACT

The present invention provides an eye shield dispenser. The dispenser includes a tower portion including a front wall, a back wall, a top wall, a bottom wall, and a pair of side walls, and an insert portion located within the tower portion, the insert portion including a front wall, and a pair side of walls attached to opposite edges of the front wall. The dispenser also includes an opening in a portion of the tower portion, and at least one tab located in the opening. The tower portion and insert portion are preferably made from a single blank of material. In another embodiment, the insert portion includes a front wall, and a first wing and a second wing attached to opposite edges of the front wall.

20 Claims, 22 Drawing Sheets

(56) References Cited

U.S. PATENT DOCUMENTS 3,352,425 A 11/1967 Burke
3,836,007 A 9/1974 Rosenwein
4,269,315 A 5/1981 Boyce
4,405,044 A * 9/1983 Flower ..... A61B 17/06061 206/738
4,673,084 A * 6/1987 Hubbard ..... B65D 5/541 206/278
4,752,029 A 6/1988 Buford
4,767,022 A 8/1988 Oldorf
4,805,765 A 2/1989 Barrett et al.
4,899,929 A 2/1990 Grollman
5,249,737 A 10/1993 Fritz et al.
5,370,220 A * 12/1994 Wang ..... A47F 1/08 206/499
5,615,767 A * 4/1997 Eull ..... B65D 5/5023 206/278
5,642,837 A 7/1997 Hayes et al.
5,794,782 A 8/1998 Ascik
5,836,478 A 11/1998 Weiss
6,253,930 B1 7/2001 Freidus
6,708,841 B2 3/2004 Baughman
6,929,133 B1 8/2005 Knapp, III et al.
7,648,048 B2 1/2010 Smith
7,658,317 B2 2/2010 Wilkins
7,922,035 B2 4/2011 Long et al.
7,971,620 B2 7/2011 Drummond et al.
8,136,697 B2 3/2012 Hackney
8,485,423 B2 7/2013 Thomas et al.
8,494,507 B1 7/2013 Tedesco et al.
10,098,787 B2 10/2018 Umentum et al.
2002/0036156 A1 3/2002 Knaack et al.
2002/0175177 A1 11/2002 Jepson
2004/0056043 A1 3/2004 Griesbach, III et al.
2005/0199690 A1 9/2005 Peterson
2005/0263575 A1* 12/2005 Weinmann ..... B65D 5/724 229/122.1
2007/0152028 A1* 7/2007 McGowan ..... B65D 5/725 229/122.1
2007/0215634 A1 9/2007 Levin
2007/0262086 A1 11/2007 Cook et al.
2008/0302864 A1 12/2008 Smith
2009/0014460 A1 1/2009 Kobus, II et al.
2009/0188015 A1 7/2009 Grad et al.
2011/0079532 A1 4/2011 Eck
2012/0012502 A1* 1/2012 Young ..... A45C 11/04 206/736
2012/0272437 A1 11/2012 Grad et al.
2013/0146501 A1 6/2013 Zusmanis et al.
2013/0206787 A1 8/2013 Shiell
2014/0076918 A1 3/2014 Hailey et al.
2014/0319204 A1 10/2014 Schultz
2014/0319205 A1 10/2014 Schultz
2015/0203268 A1 7/2015 Umentum et al.

* cited by examiner

EYE SHIELD DISPENSER

CROSS-REFERENCE TO RELATED APPLICATIONS

This application is a continuation-in-part of U.S. patent application Ser. No. 16/118,809, filed on Aug. 31, 2018, entitled "Eye Shield Dispenser," which is a continuation of U.S. patent application Ser. No. 14/264,206, filed on Apr. 29, 2014, entitled "Dispenser Having a Tower Portion and an Insert Portion," now U.S. Pat. No. 10,065,762, which claims priority from U.S. Provisional Patent Application No. 61/817,403, filed on Apr. 30, 2013, and is a continuation-in-part of U.S. patent application Ser. No. 16/248,258, filed on Jan. 15, 2019, entitled "Dispenser-Packaging for Protective Eyewear," which is a continuation of U.S. patent application Ser. No. 14/213,416, filed on Mar. 14, 2014, entitled "Dispenser-Packaging for Protective Eyewear," now U.S. Pat. No. 10,179,671, which claims priority from U.S. Provisional Patent Application No. 61/792,371, filed on Mar. 15, 2013. The entireties of each of the foregoing applications are incorporated herein by reference.

FIELD OF THE INVENTION

The present invention generally relates to a dispenser for dispensing eye shields. The eye shields can be used in connection with medical, dental, or other applications.

BACKGROUND OF THE INVENTION

Healthcare professionals often use disposable eye shields to prevent splatter of bodily fluids such as spittle and blood from entering the eyes to prevent potential infections. Healthcare professionals need to be able to have quick and ready access to such eye shields. The present invention provides storage and access to eye shields.

SUMMARY OF THE INVENTION

In one aspect, the present invention provides a dispenser tower for eye shields or frames that is easily constructed. The tower includes two portions, each made from a single blank of material, such as cardboard or plastic. The dispenser includes a tower portion including a front wall, a back wall, a top wall, a bottom wall, and a pair of side walls, and a generally trapezoidal-shaped insert portion located within the tower portion, the insert portion including a front wall, and a pair side of walls attached to opposite edges of the front wall. The dispenser also includes an opening in a portion of the tower portion, and at least one tab located in the opening.

In another embodiment, the dispenser can be a gravity fed dispenser which includes a lower portion including a front wall, a back wall, a top wall, a bottom wall, and a pair of side walls. The dispenser also includes an insert portion located within the tower portion. The insert portion includes a front wall, and a first wing and a second wing attached to opposite edges of the front wall. The dispenser has an opening in a lower portion of the tower portion. The tower portion and insert portion are each formed from a single blank of material.

Other aspects, objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

To understand the present invention, it will now be described by way of example, with reference to the accompanying drawings in which.

DETAILED DESCRIPTION

Figure 1:
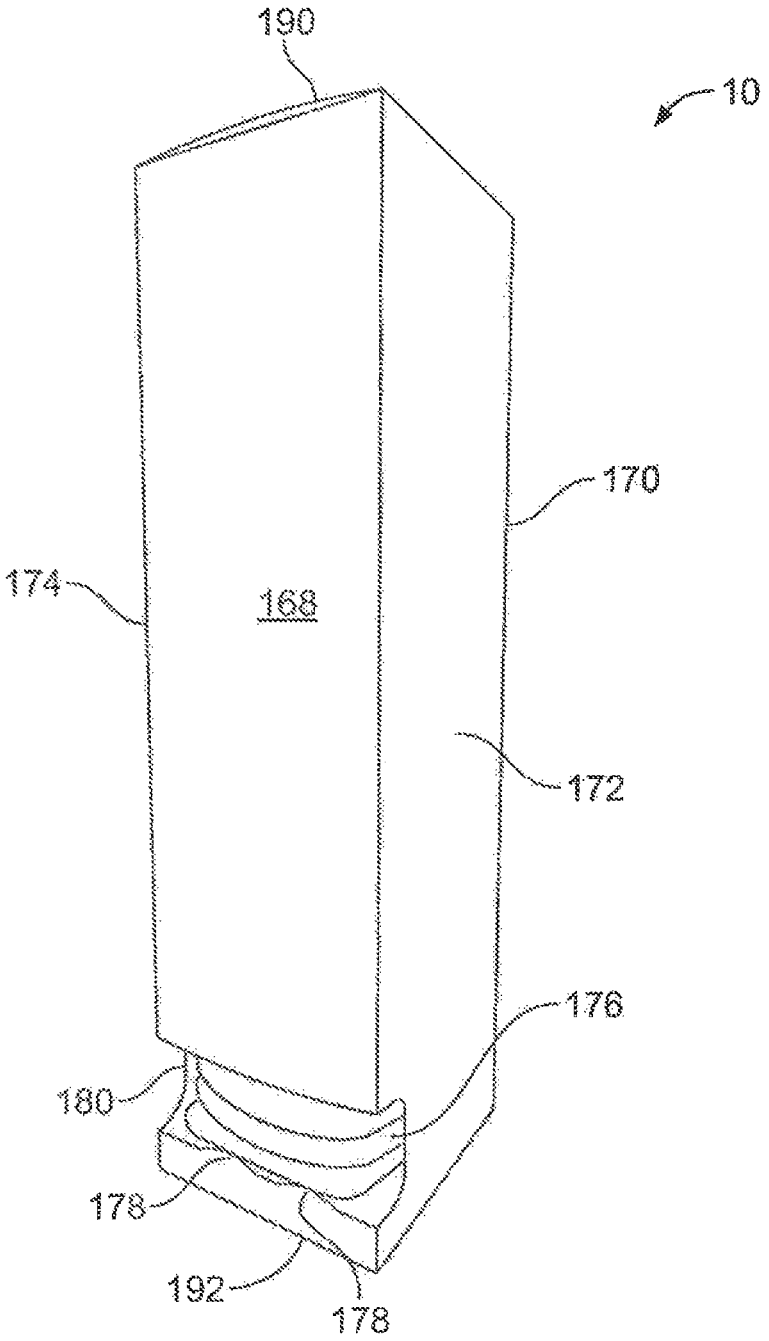
FIG. 1 is a perspective view of an eye shield lens tower dispenser made in accord with an embodiment of the present invention.
Figure 2:
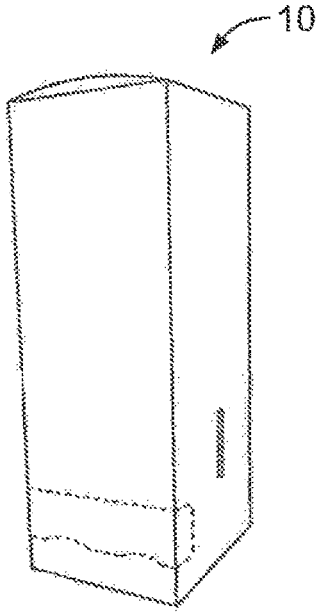
FIG. 2 is a perspective view of the tower portion of the tower dispenser of FIG. 1.
Figure 3:
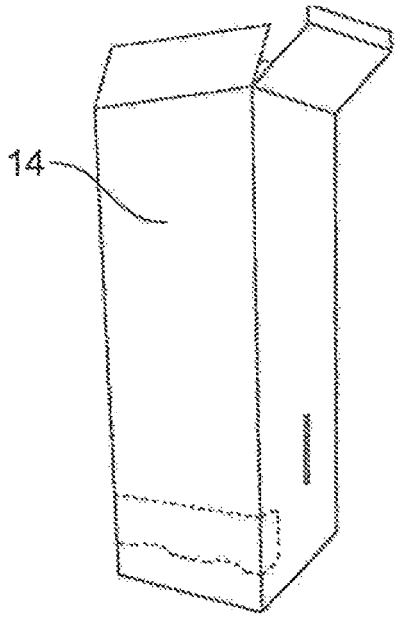
FIG. 3 is a perspective view of the tower portion of the tower dispenser of FIG. 1 wherein the top of the tower is opened.
Figure 4:
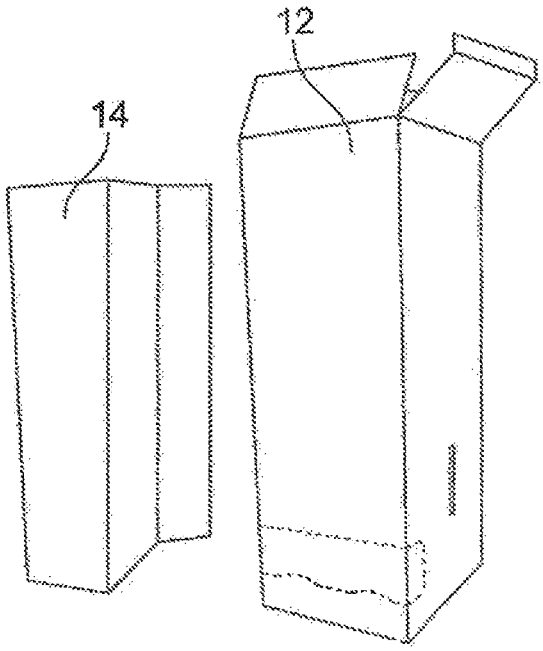
FIG. 4 is a perspective view of the tower portion and insert portion of the tower dispenser of FIG. 1.
Figure 5:
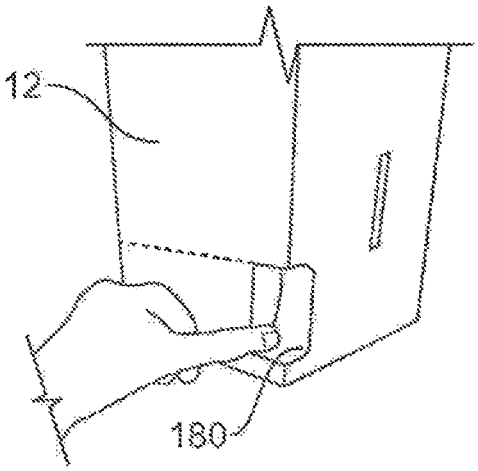
FIG. 5 is a perspective view of the tower dispenser of FIG. 1 wherein the insert portion has been inserted into the tower portion.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to the FIGS., an eye shield tower dispenser 10 is shown. The dispenser 10 includes a tower portion 12 and an insert 14. The insert 14 is placed inside the tower portion 12 to construct the dispenser as described below. The dispenser 10 is preferably made of a cardboard material, but may be made of any suitable material such as plastic.

Figure 6:
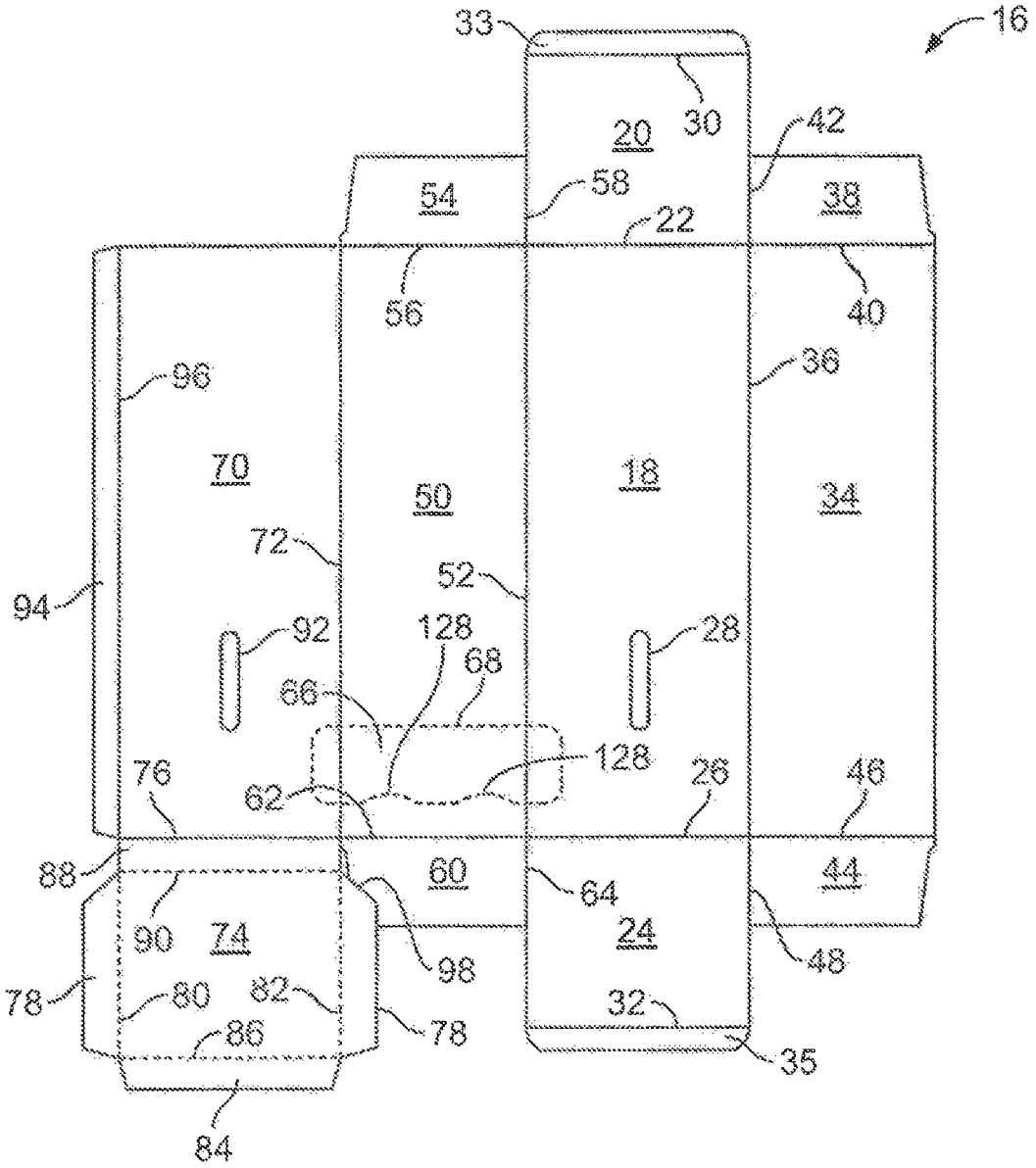
FIG. 6 is a plan view of a blank for a tower portion made in accord with an embodiment of the present invention.

The tower portion 12 and insert 14 are preferably made from a single blank of material. FIG. 6 shows a tower portion blank 16 in accord with an embodiment of the present invention. The blank 16 has a first side panel 18. A top lid panel 20 is attached to a top edge of the first side panel 18 along a first fold line 22. A bottom lid panel 24 is attached to a bottom edge of the first side panel 18 along a second fold line 26. The first side panel 18 includes a first generally oval opening 28 towards its bottom edge. The top lid panel 20 includes a third fold line 30 near its free edge. The bottom lid panel 24 includes a fourth fold line 32 near its free edge.

A back panel 34 is attached to an edge of the first side panel 18 along fifth fold line 36. A top back flap 38 is attached to a top edge of the back panel 34 along a sixth fold line 40. The top back flap 38 and top lid panel 20 are detachably attached along a first cut line 42. A bottom back flap 44 is attached to a bottom edge of the back panel 34 along a seventh fold line 46. The bottom back flap 44 and bottom lid panel 24 are detachably attached along a second cut line 48.

A front panel 50 is attached at the opposite edge of the first side panel 18 along an eighth fold line 52. A top front flap 54 is attached to a top edge of the front panel 50 along a ninth fold line 56. The top front flap 54 and top lid panel 20 are detachably attached along a third cut line 58. A bottom front flap 60 is attached to a bottom edge of the front panel 50 along a tenth fold line 62. The bottom front flap 60 and bottom lid panel 24 are detachably attached along a fourth cut line 64. A detachable cutout 66 is located toward the bottom edge of the front panel 50. The cutout is defined by perforated line 68. The cutout 66 extends partially into the first side panel 18 and a second side panel 70.

Figure 10:
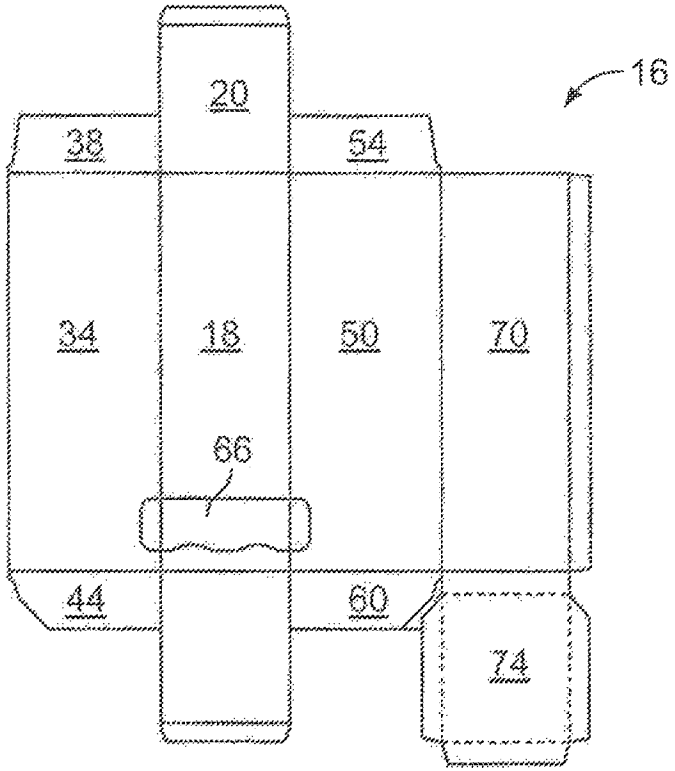
FIG. 10 is a plan view of a blank for a tower portion made in accord with an embodiment of the present invention.

The second side panel 70 is attached to an edge of the front panel 50 along an eleventh fold line 72. A bottom platform panel 74 is attached to a bottom edge of the second side panel 70 along a twelfth fold line 76. The bottom platform panel 74 includes side flaps 78 attached along thirteenth and fourteenth fold lines 80 and 82, and a front flap 84 attached along a fifteenth fold line 86. The bottom platform panel 74 also includes an attachment panel 88 formed between the twelfth fold line 76 and sixteenth fold line 90. The second side panel 70 includes a second generally oval opening 92 towards its bottom edge. A glue panel 94 is attached to an edge of the second side panel 70 along a seventeenth fold line 96. The bottom platform panel 74, bottom front flap 60, and one of the side flaps 78 are detachably attached along a fifth cut line 98. FIG. 10 shows an embodiment of the tower portion blank similar to the embodiment of FIG. 6, wherein the dimensions of the panels differ. In addition, the cutout 66 in FIG. 10 is located in the first side panel 18.

Figure 7:
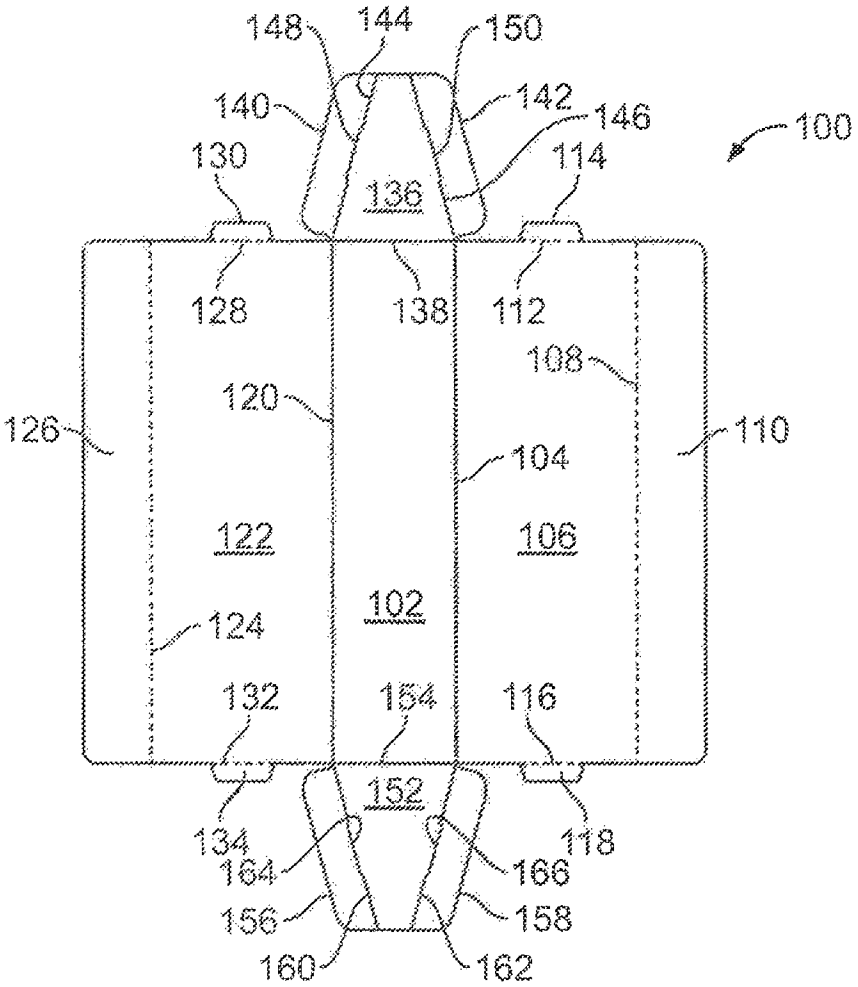
FIG. 7 is a plan view of a blank for an insert portion made in accord with an embodiment of the present invention.

FIG. 7 shows an insert blank 100 in accord with an embodiment of the present invention. The blank 100 includes a front panel 102. Attached to a first side edge of the front panel 102 along a first fold line 104 is a first side panel 106. Attached to a side edge of the first side panel 106 along a second fold line 108 is a first wing panel 110. Attached to a top edge of the first side panel 106 along a third fold line 112 is first top tab 114. Attached to a bottom edge of the first side panel 106 along a fourth fold line 116 is first bottom tab 118.

Attached to a second side edge of the front panel 102 along a fifth fold line 120 is a second side panel 122. Attached to a side edge of the second side panel 122 along a sixth fold line 124 is a second wing panel 126. Attached to a top edge of the second side panel 122 along a seventh fold line 128 is second top tab 130. Attached to a bottom edge of the second side panel 122 along an eighth fold line 132 is second bottom tab 134.

A top end panel 136 is attached to a top edge of the front panel 102 along a ninth fold line 138. The top end panel 136 is preferably trapezoidal shaped and tapered inward from the top edge of the front panel 102. The top edge panel 136 includes wings 140 and 142 attached thereto along fold lines 144 and 146. Fold lines 144 and 146 include slots 148 and 150, respectively, along their length.

A bottom end panel 152 is attached to a bottom edge of the front panel 102 along a tenth fold line 154. The bottom end panel 152 is preferably trapezoidal shaped and tapered inward from the bottom edge of the front panel 102. The bottom end panel 152 includes wings 156 and 158 attached thereto along fold lines 160 and 162. Fold lines 160 and 162 include slots 164 and 166, respectively, along their length.

To construct tower dispenser 10, tower blank 16 and insert blank 100 are separately erected. To erect the tower portion 12 from tower blank 16, top back flap 38 and top front flap 54 are separated from the top lid panel 20 along cut lines 42 and 58. Bottom back flap 44 is separated from the bottom lid panel 24 along cut line 48. Bottom front flap 60 is separated from bottom lid panel 24 along cut line 64 and from side flap 78 and bottom platform panel 74.

The back panel 34, first side panel 18, front panel 50 and second side panel 70 are folded inwards along fold lines 36, 52, and 72. Glue is applied to glue panel 94, which is attached to the inner surface of the back panel 34; thus forming a front wall 168, back wall 170, and first and second side walls 172 and 174.

Bottom platform panel 74 is folded inward along fold line 76. Fold lines 80, 82, 86 and 90 are folded such that the bottom platform panel 74 is raised to the level the height of the attachment panel 88. Flaps 78 and 84 and attachment panel 88 are glued to the inner surfaces of the front panel 50, first and second side panels 18 and 70, and back panel 34. Bottom front flap 60 and bottom back flap 44 are folded inward over the bottom platform panel 74 and bottom lid panel 24 is folded over the bottom front and back flaps 60 and 64. Bottom lid panel 24 is folded along fold line 32 and the resulting flap 33 is tucked in to secure the bottom lid panel 24 to create a bottom wall 192.

Inserted blank 100 is erected by folding the first and second side panels 106 and 122 inward along fold lines 104 and 120, respectively. First and second wing panels 110 and 126 are folded outward along fold lines 108 and 124, respectively. Top end panel 136 and bottom end panel 152 are folded inward along fold lines 138 and 154. Wings 140 and 142 of the top end panel 136 are folded inward along fold lines 144 and 146. First and second top tabs 114 and 130 are folded inward along fold lines 112 and 128. First top tab 114 is inserted into slot 150. Second top tab 128 is inserted into slot 148.

Likewise, wings 156 and 158 of the bottom end panel 152 are folded inward along fold lines 160 and 162. First and second bottom tabs 118 and 134 are folded inward along fold lines 116 and 132. First bottom tab 118 is inserted into slot 166. Second bottom tab 134 is inserted into slot 164.

The assembled insert blank 100 is then inserted into the tower portion 12 such that the front panel 102 of the insert blank 100 and the front panel 50 of the tower portion blank 16 are aligned. The first and second wing panels 110 and 126 fold outward and abut the first and second side panels 24 and 50 of the tower panel 16. The detachable cutout 66 is removed along perforation 68 leaving an opening 180 with a pair of tabs 178.

Eye shields 176 are placed and stacked inside the tower portion 12 through the upper end of the tower portion 12 such that the lens portion of the eye shields align between the front panel 50 of the tower portion 12 and the front panel 102 of the insert portion 14, while the earpieces ride along then the side panels 106 and 122 of the insert portion 14. The eye shields 176 are supported on the bottom platform panel 74. The user removes the eye shields 176 from the tower portion 12 through the opening 180. The tabs 178 help to retain the eye shields 176 within the tower portion 12 until removed by the user.

When the eye shields 176 are placed within the tower portion 12, the top back flap 38 and top front flap 54 are detached from the top lid panel 20 along cut lines 42 and 58. The top front and back flaps 38 and 54 are folded inward along fold lines 40 and 56, respectively. The top lid panel 20 is folded inward along fold line 22 over the top front and back flaps 38 and 54. Top lid panel 20 is folded along fold line 30 and the resulting flap 35 is tucked in to secure the top lid panel 20 to create top wall 190.

Figure 8:
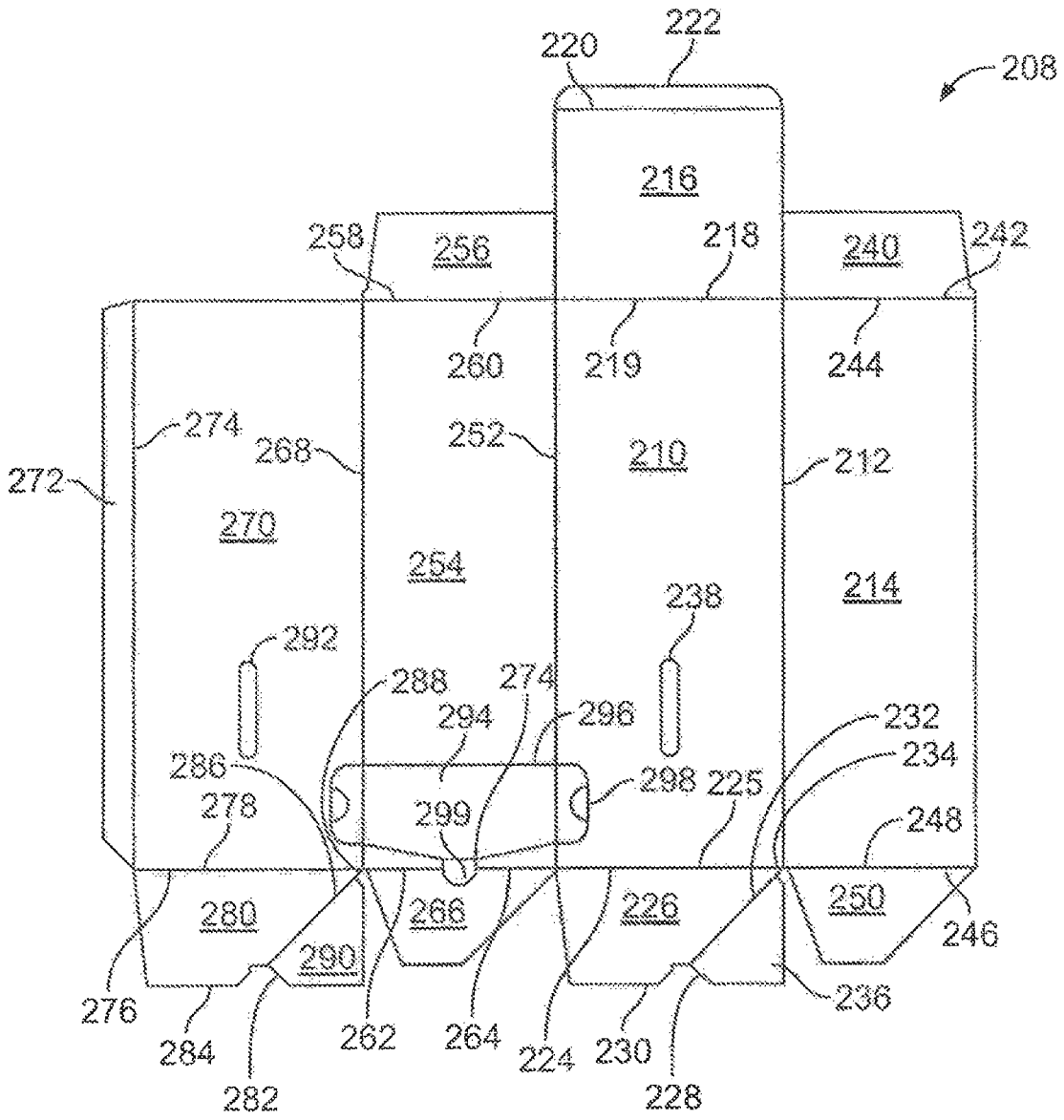
FIG. 8 is a plan view of a blank for a tower portion made in accord with an embodiment of the present invention.
Figure 9:
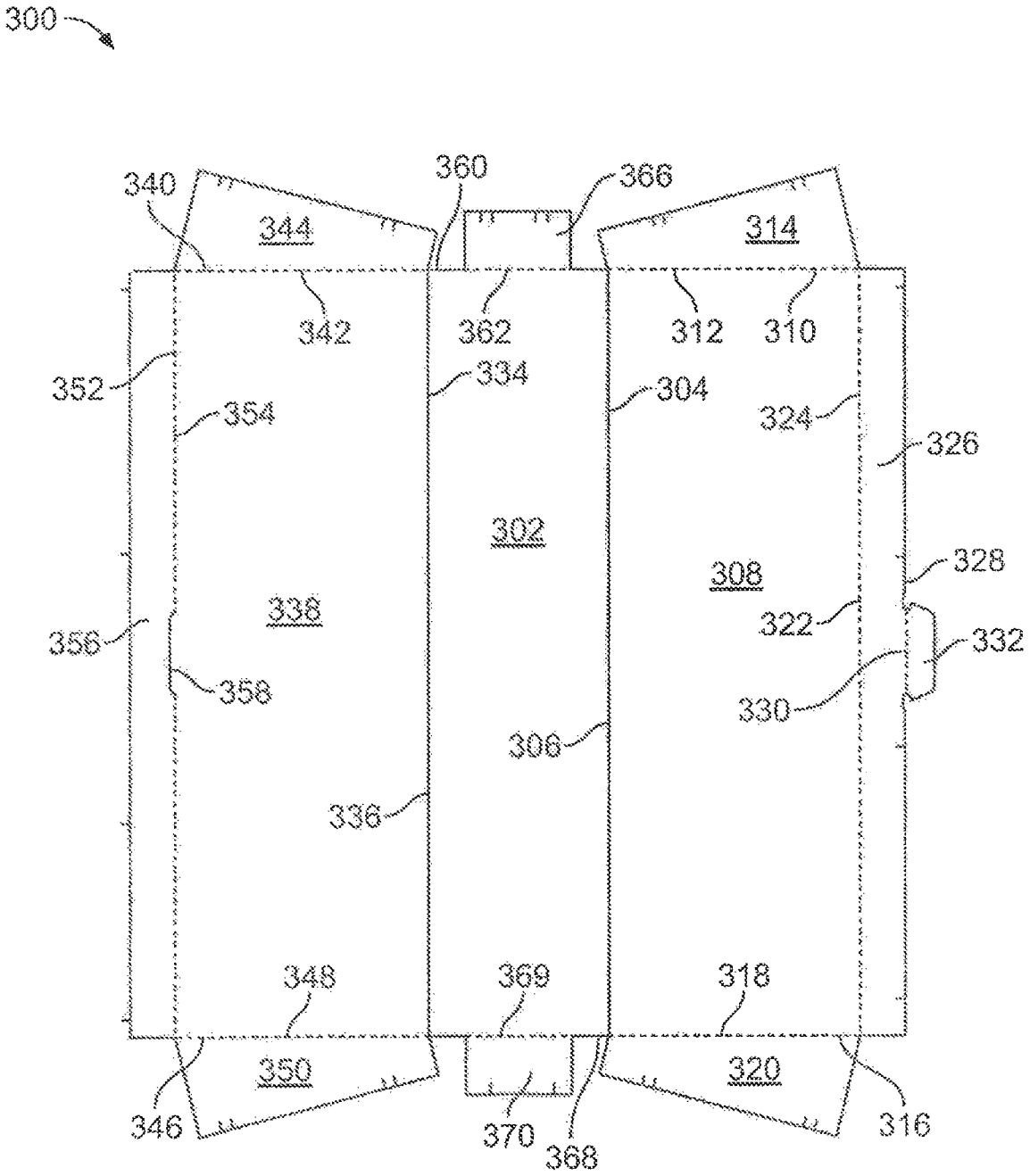
FIG. 9 is a plan view of a blank for an insert portion made in accord with an embodiment of the present invention.

In another embodiment shown in FIGS. 8-9, the eye shield dispenser 10 is made from single blanks 208 and 300. FIG. 8 shows the blank 208 from which the tower portion 12 is assembled. The blank 208 includes a first side panel 210. Attached to the first side panel 210 along a first fold line 212 is a back panel 214. A top lid panel 216 is attached to a top edge 218 of the first side panel 210 along a second fold line 219. The top lid panel 216 includes a top lid fold line 220 near its free edge 222. Also attached to a bottom edge 224 of the first side panel 210 along a third fold line 225 is a first bottom panel 226. The first bottom panel 226 includes a first cutout portion 228 generally in the center of its free edge 230. The first bottom panel 226 has a diagonal fourth fold line 232 extending from the first cutout portion 228 generally toward a first corner 234. When folded the diagonal fourth fold line 232 creates a first tab 236. The first side panel 210 can include an oval or any suitable shaped opening 238 placed near the bottom edge 234.

The back panel 214 includes a top back flap 240 attached to a top edge 242 along a fifth fold line 244. Attached to a bottom edge 246 along a sixth fold line 248 is a generally trapezoidal bottom back flap 250.

Also attached to the first side panel 210 along a seventh fold line 252 is a front panel 254. The front panel 254 includes a top front flap 256 attached to a top edge 258 along an eighth fold line 260. Attached to a bottom edge 262 along a ninth fold line 264 is a generally trapezoidal bottom front flap 266.

Attached to the front panel 254 along a tenth fold line 268 is a second side panel 270. The second side panel 270 includes a glue flap 272 attached along an eleventh fold line 274. Also attached to a bottom edge 276 of the second side panel 270 along a twelfth fold line 278 is a second bottom panel 280. The second bottom panel 280 includes a second cutout portion 282 generally in the center of its free edge 284. The second bottom panel 280 has a diagonal thirteenth fold line 286 extending from the second cutout portion 282 generally toward a second corner 288. When folded the diagonal thirteenth fold line 286 creates a second tab 290. The second side panel 270 can include an oval or any suitable shaped opening 296 placed near the bottom edge 276. A detachable cutout 294 is located toward the bottom edge of the front panel 254. The cutout 294 is defined by perforated line 296. The cutout 294 extends partially into the first side panel 210 and a second side panel 270. The cutout 294 includes openings 298 on opposite sides of the cutout 294. The cutout 294 also includes a tab 299 that extends into the bottom front flap 266.

FIG. 9 shows an insert blank 300 to be erected into the insert 14 and inserted into the tower portion 12. The blank 300 includes a front panel 302. Attached to a first edge 304 of the front panel 302 along a first fold line 306 is a first wing panel 308. The first wing panel 308 is generally rectangular. Attached to a top edge 310 of the first wing panel 308 along a second fold line 312 is a first top flap 314. Attached to a bottom edge 316 of the first wing panel 308 along a third fold line 318 is a back bottom flap 320. Attached to a side edge 322 of the first wing panel 308 along a fourth fold line 324 is a first end flap 326. Along an outer edge 328 along a fifth fold line 330 of the first end flap 326 is a tab 332.

Attached to a second edge 334 of the front panel 302 along a sixth fold line 336 is a second wing panel 338. The second wing panel 338 is generally rectangular. Attached to a top edge 340 of the second wing panel 338 along a seventh fold line 342 is a second top flap 344. Attached to a bottom flap 346 of the second wing panel 308 along an eighth fold line 348 is a second bottom flap 350. Attached to a side edge 352 of the second wing panel 338 along a ninth fold line 354 is a second end flap 356. Along the ninth fold line 354 is a slot 358 to accommodate tab 330.

Attached to a top edge 360 of the front panel 302 along a tenth fold line 362 is a front top flap 366. Attached to a bottom edge 368 of the front panel 302 along an eleventh fold line 369 is a front bottom flap 370.

To assemble the dispenser 10 from the blanks 208 and 300, the tower portion 12 is erected. To erect the tower portion 12, the first side panel, back panel, front panel and second side panel are folded inward along fold lines 212, 252, and 268. The first and second bottom panels 226 and 280 are folded inward along fold lines 225, 248, 264 and 278 such that the cutouts 228 and 282 of the first and second bottom panels 226 and 280 engage. The front and back bottom flaps 250 and 266 are folded inward along fold lines 248 and 264. This forms the bottom of the tower portion 12. The glue flap 272 of the second side panel 270 is glued to the back panel 214. This forms the tower portion 12.

The insert 14 is assembled from blank 308 by folding the first and second wing portions 308 and 338 inwardly along fold lines 306 and 336 such that the tab 332 is inserted into slot 358. The first and second top flaps 314 and 344 and first second bottom flaps 320 and 350 are folded outwardly along fold lines 312, 342, 318, and 348. The top and bottom front flaps 366 are 370 are folded inwardly along fold lines 362 and 369. This forms the insert 14.

The insert 14 is then inserted into the tower portion 12. Eye shields or other items are inserted into the dispenser 10. The detachable cutout 294 is removed from tower portion 12 by inserting a finger into the openings 298 and pulling outwardly, such that an opening 180 is created. When the cutout 294 is removed, tab 299 created a scallop 374 extending into bottom front flap 370 to facilitate removal of eye shields from the dispenser 10. The dispenser 10 is closed by folding the top back and front flaps 240 and 256 inward along fold lines 244 and 260, and then folding the top lid 216 inward along fold line 219 over the top flaps 24 and 256 and tucking the top lid flap 216 using top lid fold line 220.

Figure 11:
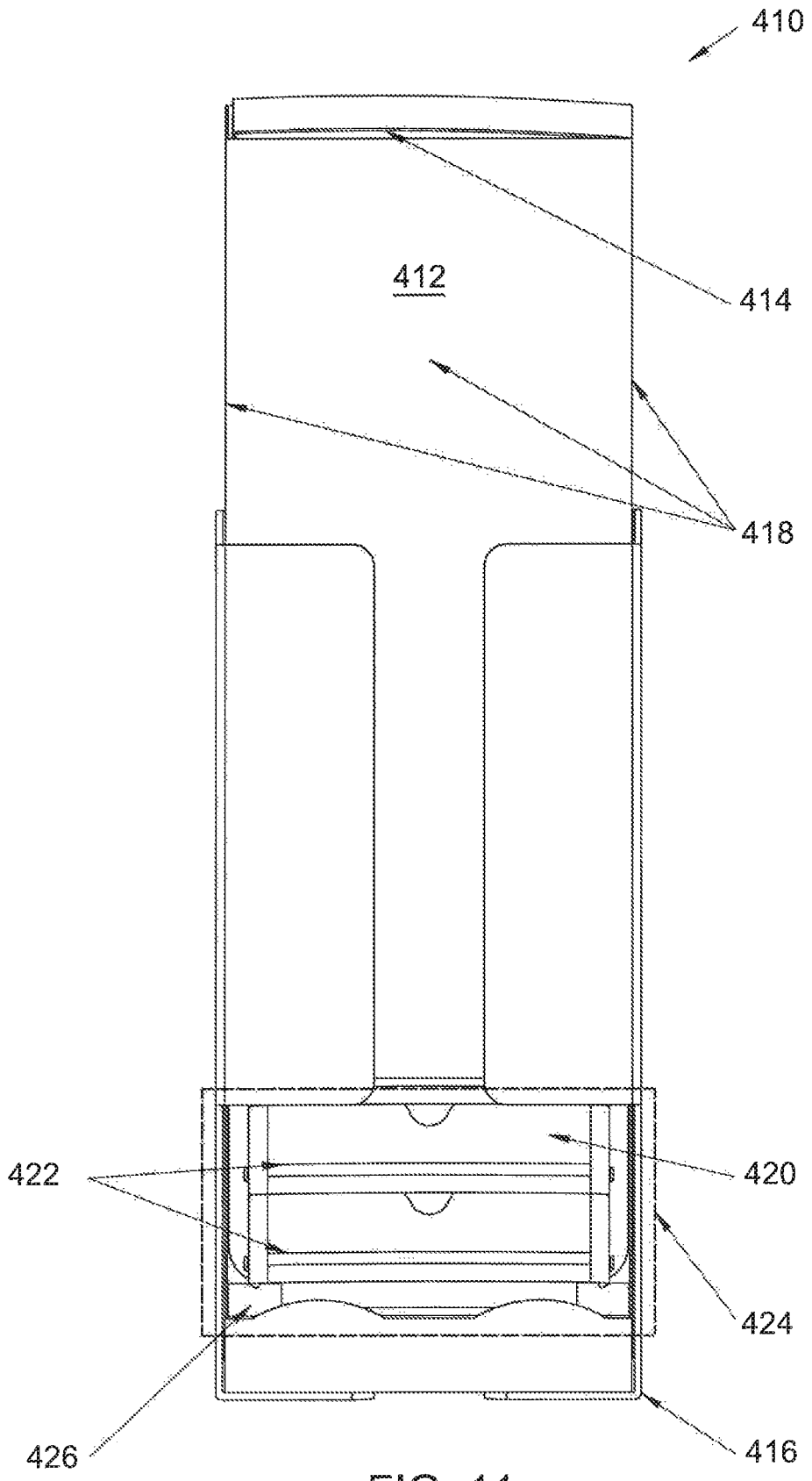
FIG. 11 is a front perspective view of an assembled dispenser-package for storing and distributing protective eyewear glasses held in an exterior enclosure in accord with an embodiment of the present invention.

In another embodiment shown in FIG. 11, an assembled dispenser-package 410 for storing protective eyewear glasses comprises an exterior box 412 having a top 414, a bottom 416 and four sidewalls 418 along a first length from the top 414 to the bottom 416. The dispenser-package 410 may be manufactured, for example, from conventional cardboard or paper. An interior retention mechanism 420 holds a plurality of protective eyewear glasses 422 along a second length from the top of the interior retention mechanism 420 to the bottom of the interior retention mechanism 420. The exterior box 412 completely receives the interior retention mechanism 420 and securely holds the plurality of protective eyewear glasses 422 in place.

The exterior box 412 includes a detachable area 424 in proximity to the bottom 416 of exterior box 412 to allow accessing one or more of the protective eyewear glasses 422 held in place at a time. The detachable area 424 may be formed by perforations in the exterior box 412 and may include one or more tabs for ease of removal of the detachable area 424. As a result, the exterior box 412 in a first state, e.g., during shipment, may be fully enclosed without openings, while the exterior box 412 in a second state, e.g., during use in a healthcare facility, has an opening defined by the detachable area 424. The exterior box 412 may include indentations, impressions, cut lines and/or any other features facilitating area removal on or in proximity to the detachable area 424 to further facilitate such removal.

Figure 25:
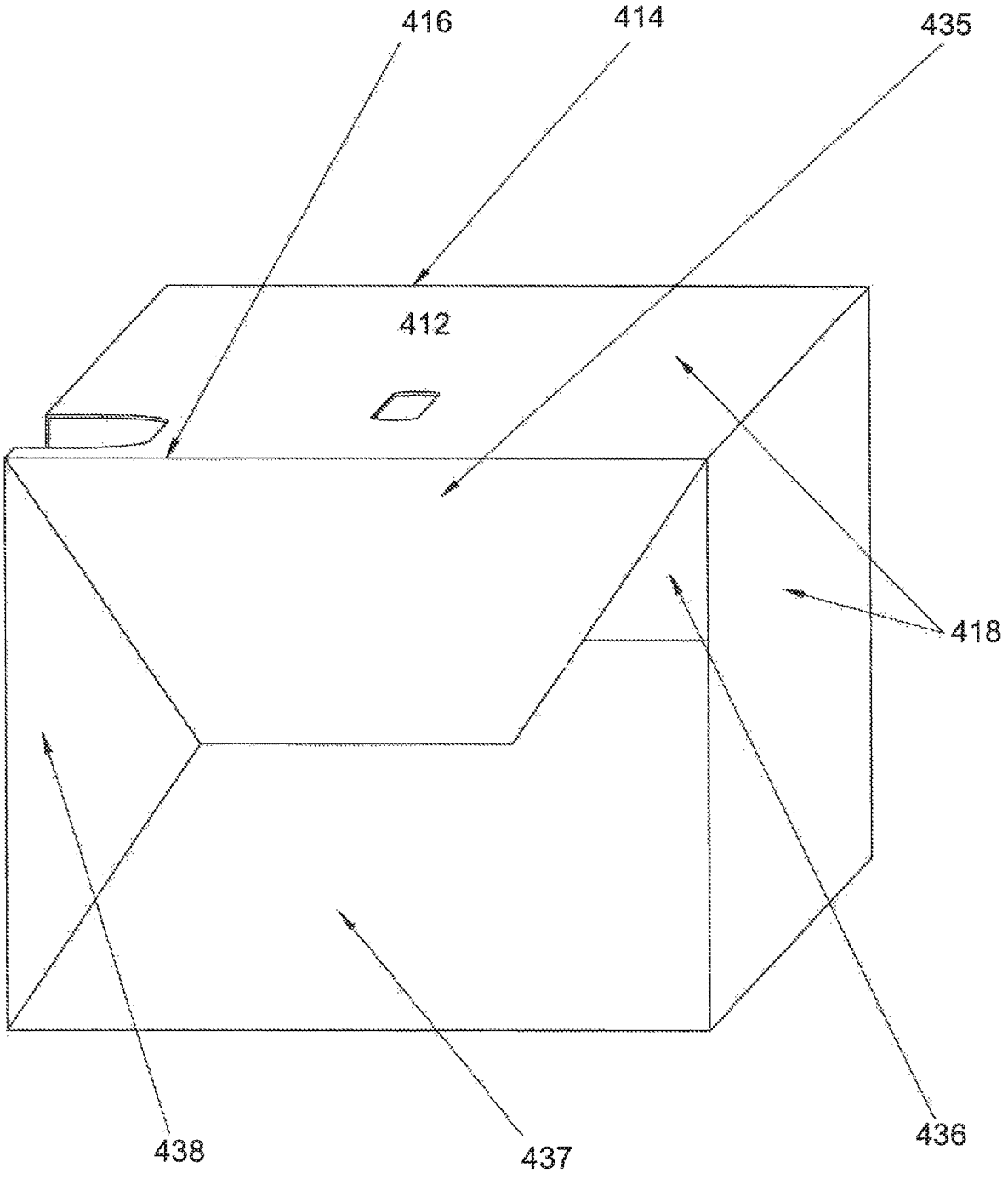
FIG. 25 is a bottom perspective view of the assembled dispenser-package of FIG. 11 with bottom flaps closed.
Figure 26:
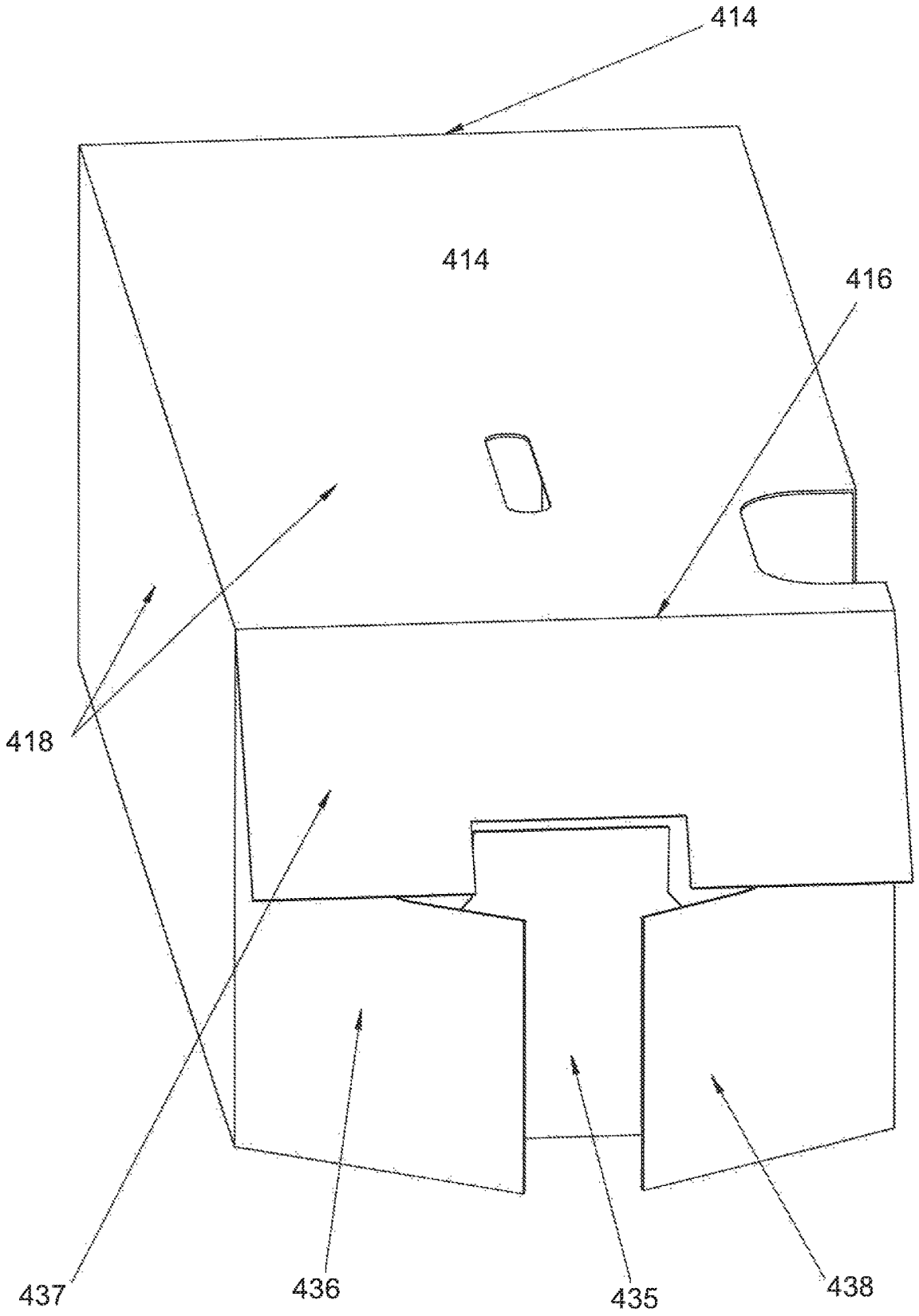
FIG. 26 is a bottom perspective view of the assembled dispenser-package of FIG. 11 with bottom flaps opened.

The exterior box 412 may also include a spacer 426 held within the exterior box 412 between the end of the second length of the interior retention mechanism 420 and the remaining portion of the first length of the exterior box 412 for securely holding the interior retention mechanism 420 in the exterior box 412. As such, the spacer 426 minimizes movement of the interior retention mechanism 420 within the exterior box 412. In a preferred embodiment, the spacer 426 is in proximity to the bottom of the exterior box 412 to increase rigidity of the bottom 416 after the detachable area 424 is removed. Accordingly, the spacer may serve to position the protective eyewear glasses 422 such that only one pair may be dispensed at time, thereby preventing remaining protective eyewear glasses 422 from falling out of the box and becoming contaminated or dirtied on the floor. In lieu of the spacer 426, or in addition thereto, folds in the exterior box 412 and/or the interior retention mechanism 420, and/or stronger materials thereof, may provide equivalent functionality as desired. For example, as depicted in FIGS. 25 and 26, at the bottom 416, each side may fold in toward the center, and/or one side may include a flap that inserts into a slit on the opposing side, to securely hold the bottom 416 in position and to evenly withstand increased weight from above, with or without inclusion of the spacer 426.

An exterior enclosure 428 substantially surrounds the exterior box 412 for rigidly supporting the exterior box 412. The exterior enclosure 428 may comprise surrounding sides and a bottom for rigidly supporting the exterior box 412, while leaving the top open and accessible to facilitate ease of insertion and removal of the exterior box 412. The exterior enclosure 428 may be manufactured from any cost-effective, rigid material, such as plastic; and in a preferred embodiment, is manufactured from a rigid, transparent plastic.

The exterior enclosure 428 also comprises means for mounting the exterior enclosure 428 to a wall or other sturdy surface. In particular, the exterior enclosure 428 may include holes for positioning onto wall mounted screws, nails, hooks, or other fasteners; or may include hooks or other fasteners, adhesives, hook and loop fabric, angling of the exterior enclosure 428 for hanging over a surface, or any other similar mounting mechanism as known in the art.

In operation, the exterior box 412 containing the plurality of protective eyewear glasses 422 may arrive at a healthcare facility. The exterior box 412 may be alone or among other exterior boxes 412 in a larger shipping box, or the exterior box 412 may also serve as the shipping box with appropriate shipping labels affixed thereto. At the healthcare facility, the exterior box 412 may be inserted into the (empty) exterior enclosure 428 which is mounted in an appropriate and accessible location in the healthcare facility. Then, the detachable area 424 is removed by tearing away along perforations defining the detachable area 424 from the area in proximity to the bottom 416 of exterior box 412.

Next, one or more of the protective eyewear glasses 422 are retrieved through the area now exposed by removal of the detachable area 424. Removal of a single pair of protective eyewear glasses 422 allows remaining protective eyewear glasses 422 along the interior retention mechanism 420 to slide downward to the bottom with gravity when the exterior box 412 is positioned upright. Finally, once all of the protective eyewear glasses 422 have been removed, the exterior box 412 is removed from exterior enclosure 428 and a replacement exterior box 412 is inserted into the (empty) exterior enclosure 428 and the process is repeated.

In accordance with an embodiment, a method for storing the protective eyewear glasses 422 may comprise holding the plurality of protective eyewear glasses 422 in place along the length of the interior retention mechanism 420, and placing the interior retention mechanism 422 completely in the exterior box 418. The exterior box 418, again, includes the detachable area 424 in proximity to the bottom to allow accessing one or more of the protective eyewear glasses 422 held in place.

Figure 12:
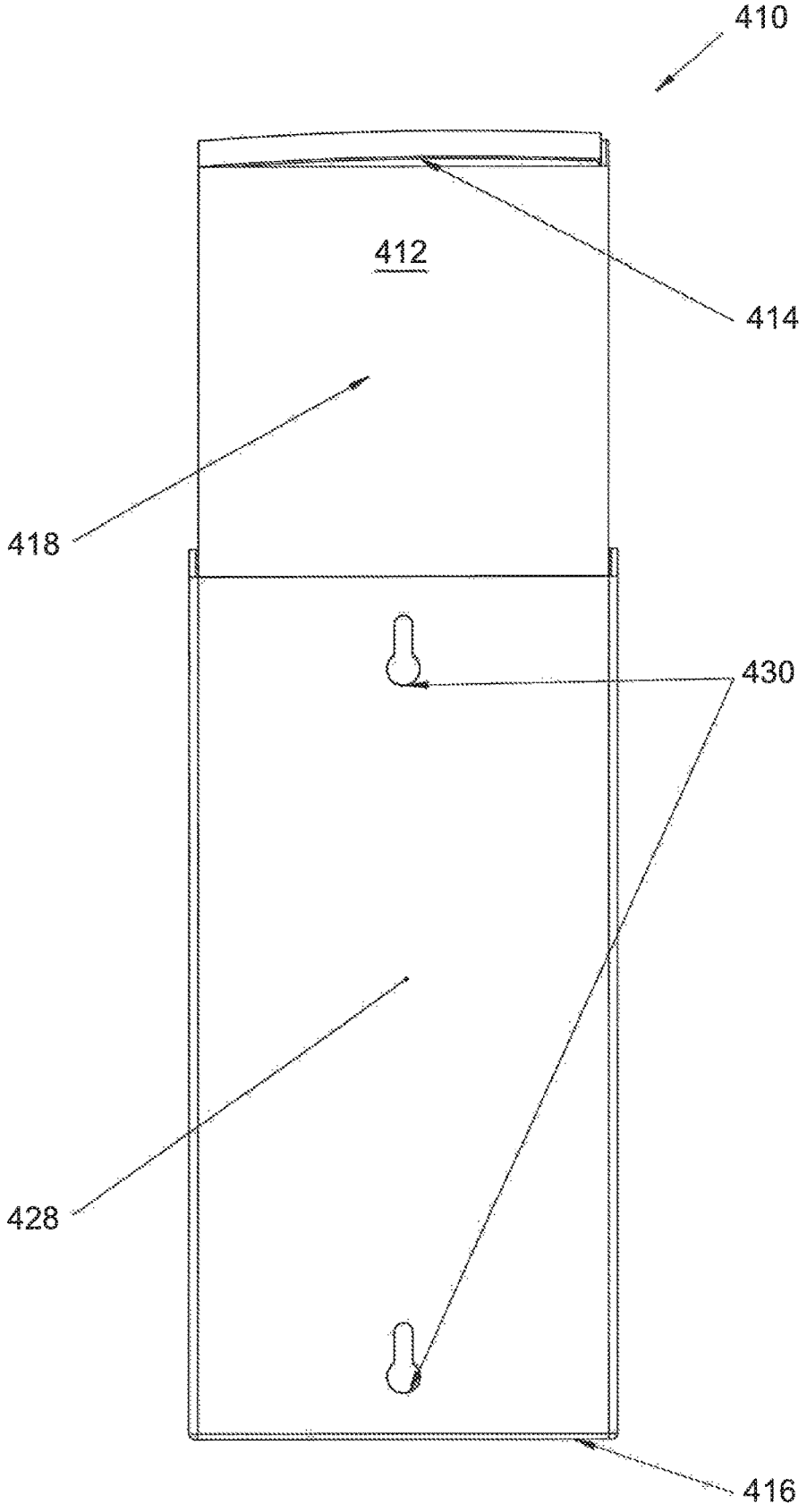
FIG. 12 is a rear perspective view of the assembled dispenser-package as shown in FIG. 11.
Figure 13:
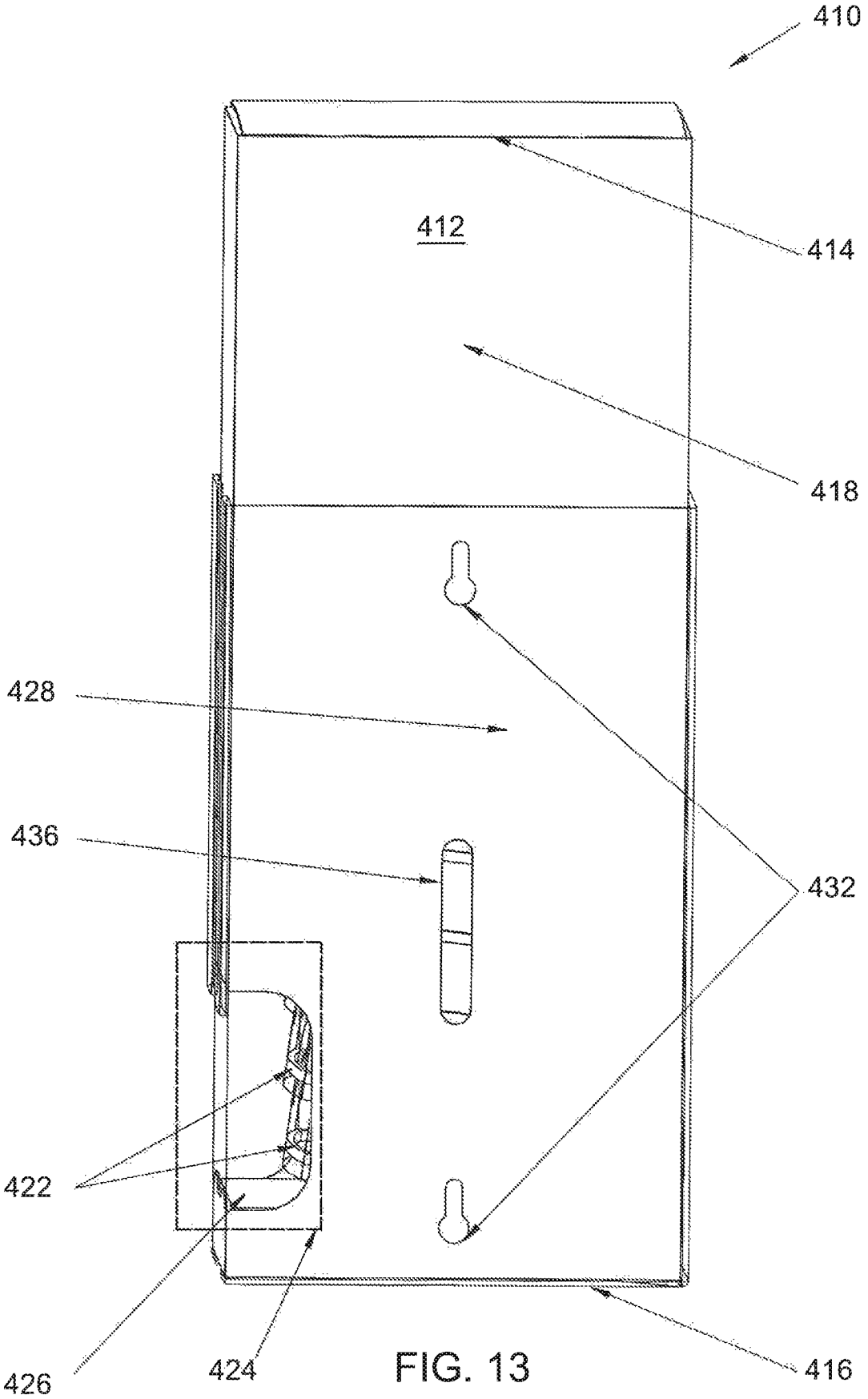
FIG. 13 is a left side perspective view of the assembled dispenser-package as shown in FIG. 11.
Figure 14:
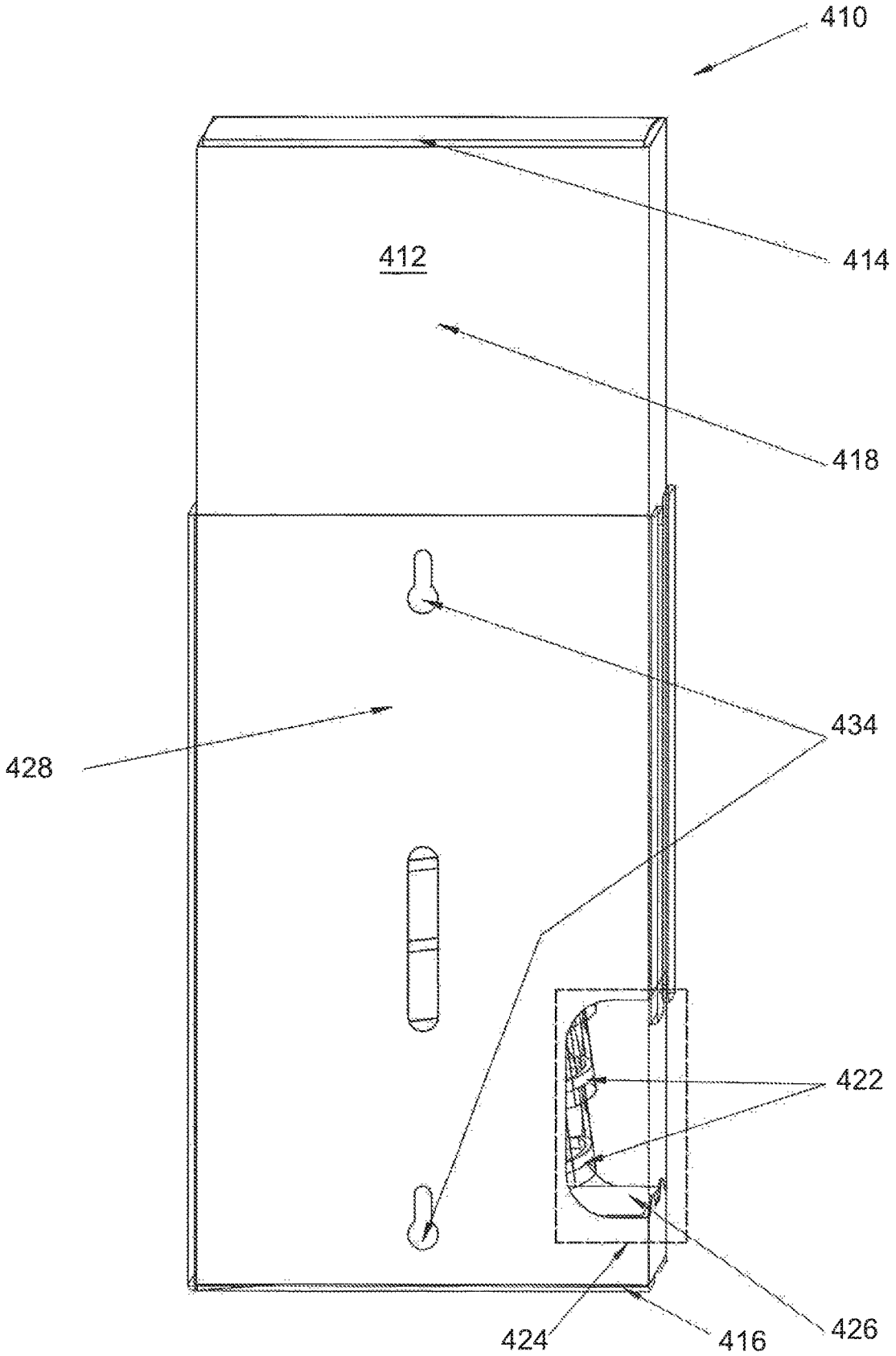
FIG. 14 is a right side perspective view of the assembled dispenser-package as shown in FIG. 11.

Turning now to FIG. 12-14, rear, left and right side perspective views of the assembled dispenser-package 410 of FIG. 11 are shown, respectively. The rear of the exterior enclosure 428 includes a pair of mounting holes with grooves 430 for wall mounting. Similarly, the left side and the right side of the exterior enclosure 428 also include pairs of mounting holes with grooves 432 and 434, respectively, for wall mounting.

In addition, the left side and the right side of the exterior box 412 include openings 436 and 438, respectively, in sidewalls 418 of the exterior box 412, for showing remaining protective eyewear glasses along the interior retention mechanism 420 to facilitate timely reordering. The openings 436 and 438 in sidewalls 418 are visible through the transparent exterior enclosure 428. In a preferred embodiment, the openings 436 and 438 are in proximity to the bottom of the exterior box to monitor nearing the end of protective eyewear glasses 422 remaining.

Indicia for facilitating reordering of the protective eyewear glasses 422 may also appear on the exterior box 412. The indicia may be, for example, a Quick Response ("QR") Code, a barcode, a reorder number, reorder instructions, an Internet address, and so forth, which may be linked to or otherwise facilitate reordering of the protective eyewear glasses 422. In a preferred embodiment, the indicia may be in proximity to openings 436 and 438 such that monitoring nearing the end of the protective eyewear glasses 422 may conveniently accompany reordering the protective eyewear glasses 422.

Figure 15:
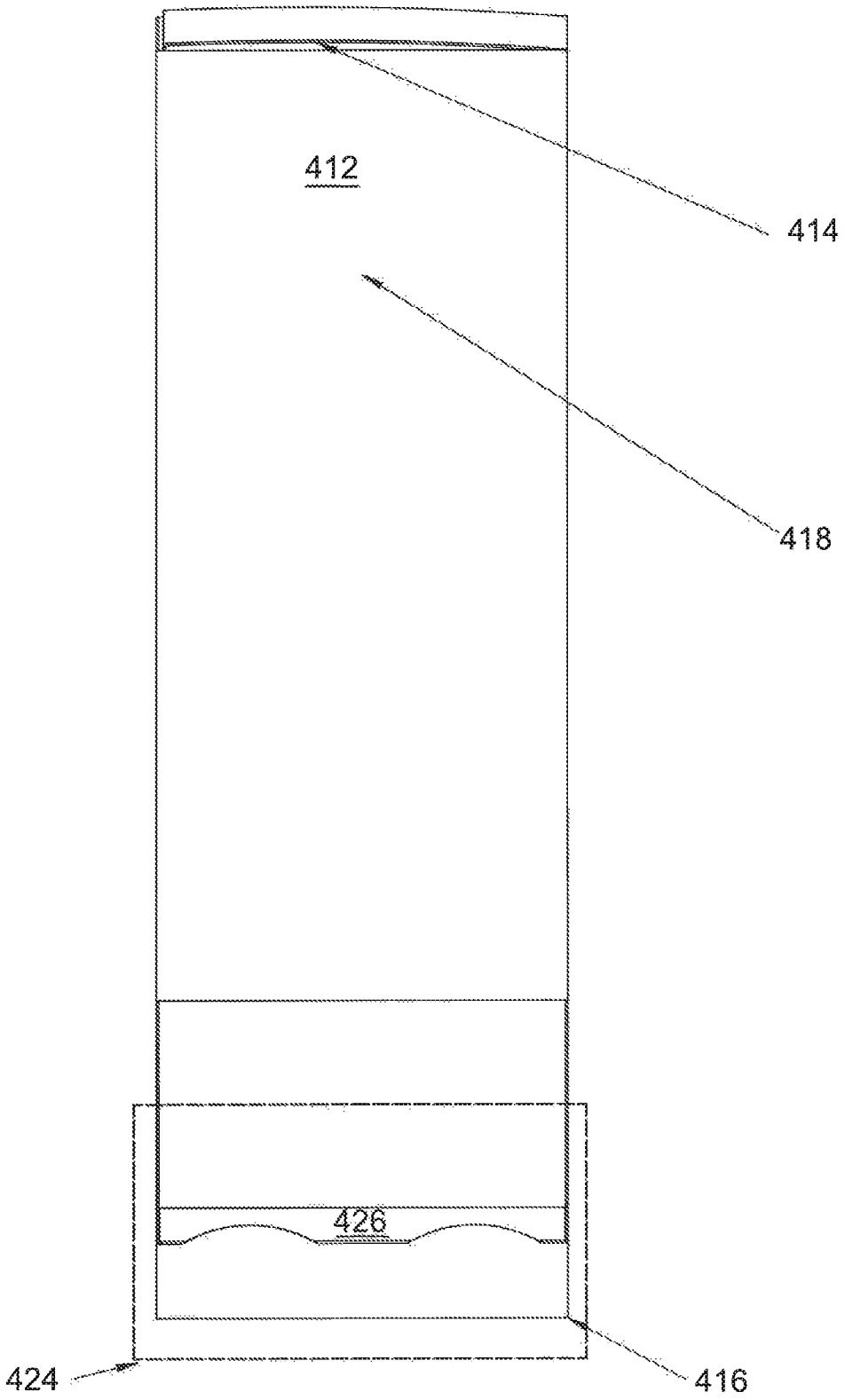
FIG. 15 is a front perspective view of the exterior box of FIG. 11.
Figure 16:
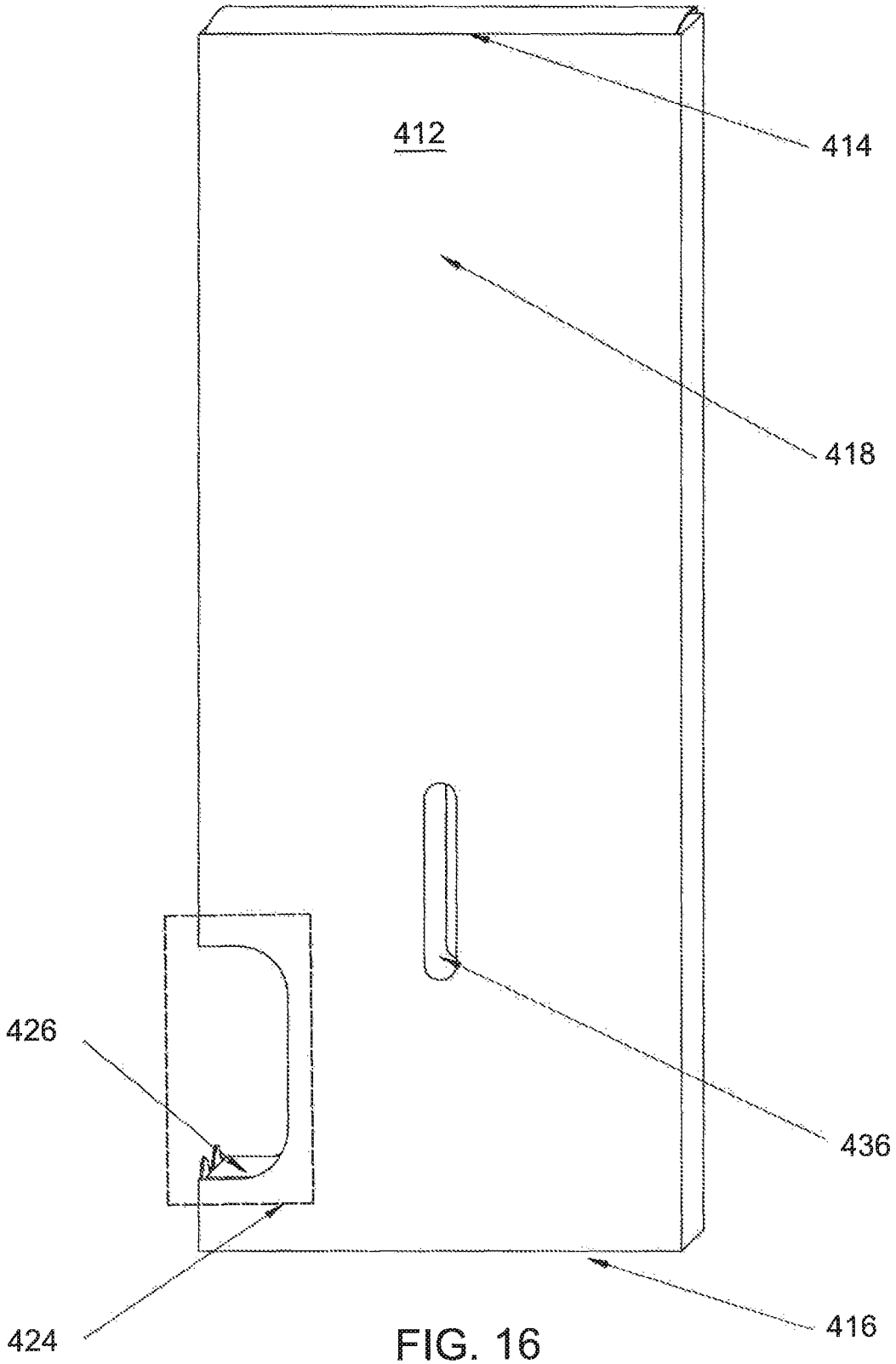
FIG. 16 is a left side perspective view of the exterior box of FIG. 11.
Figure 17:
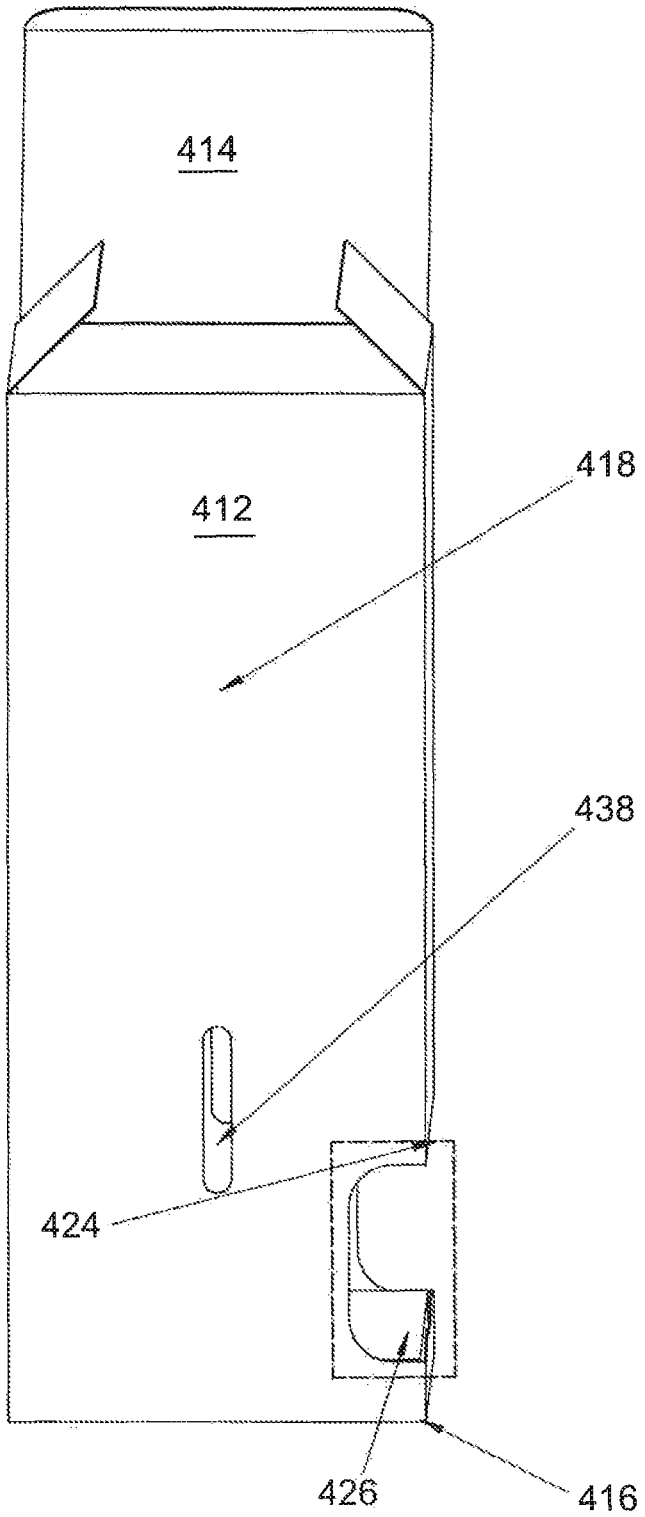
FIG. 17 is a right side perspective view of the exterior box of FIG. 11.

Turning now to FIGS. 15-17, front, left and right side perspective views of the exterior box 412 of FIG. 11 are shown, respectively. The top 414 and the bottom 416 of the exterior box 412 may comprise a plurality of flaps for sealing the top 414 together and the bottom 416 together as in conventional boxes. In addition, the exterior box 412 may collapse flat when the plurality of flaps for sealing the top 414 and the bottom 416 are fully opened, as in conventional boxes.

Figure 18:
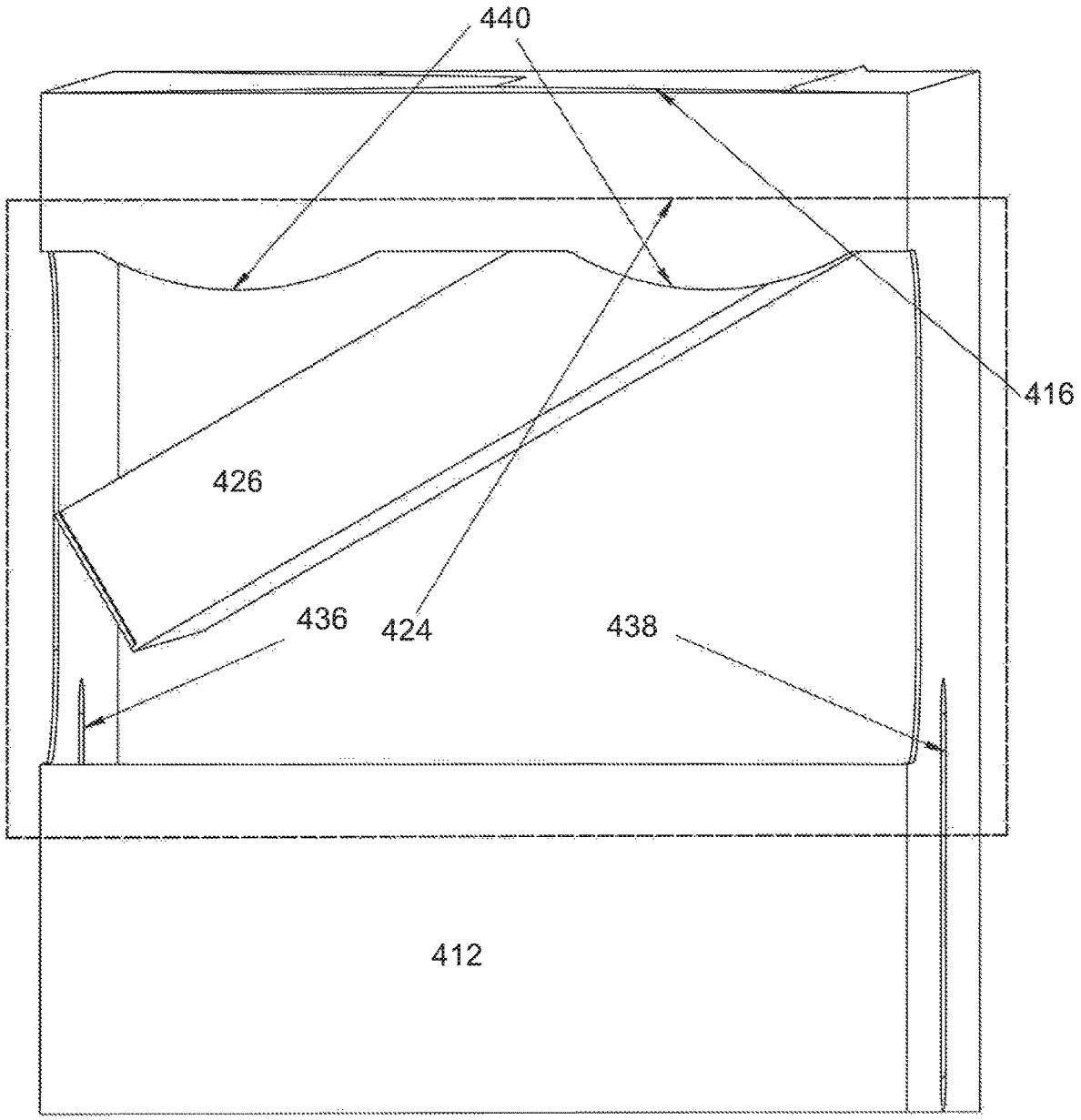
FIG. 18 is a detachable area in proximity to the bottom of the exterior box of FIG. 11 to allow accessing one or more of the protective eyewear glasses held in place.

Turning now to FIG. 18, a closer view of the detachable area 424 of the exterior box 412 of FIG. 11 is shown. Removal of the detachable area 424 allows accessing one or more of the protective eyewear glasses 422 when present. Impression areas 440 located in proximity to the lower side of the detachable area 424 allow ease of removal of the detachable area 424 by pushing against the impression areas 440 to begin breaking perforations that form the detachable area 424. Alternative embodiments for the detachable area 424 may provide indentations, cut lines, removable adhesives and/or other techniques as known in the art.

As shown in FIG. 18, the spacer 426 is lifted upward from the bottom 416 of the exterior box 412 to reveal its additional detail. Accordingly, the spacer 426 may comprise a separate, detachable piece from the exterior box 412 formed of cardboard or paper folded together. An alternative embodiment may provide a spacer that is formed as part of the exterior box.

Figure 19:
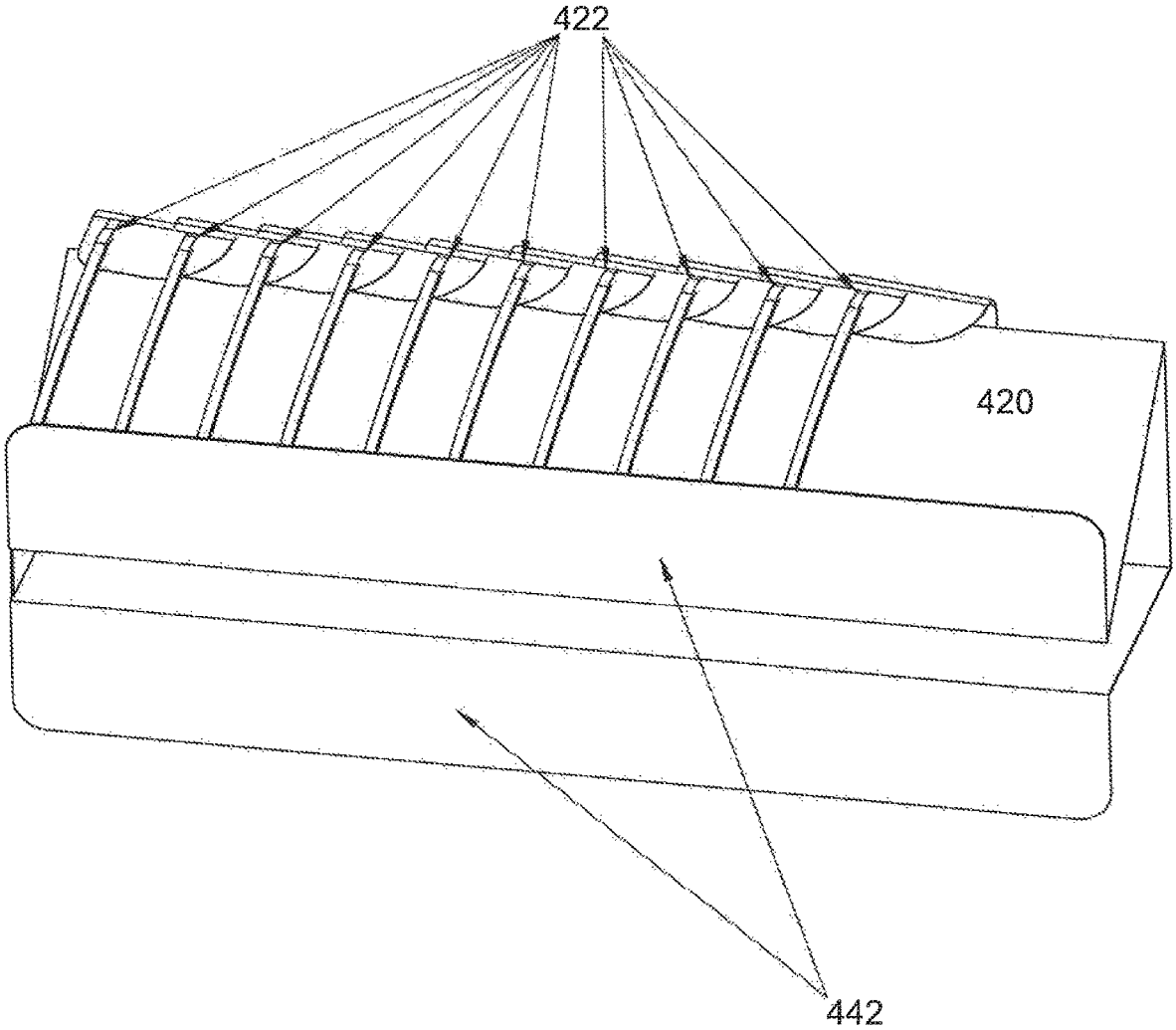
FIG. 19 is an interior retention mechanism for holding the plurality of protective eyewear glasses in accord with an embodiment of the present invention.

Turning now to FIG. 19, the interior retention mechanism 420 holds the plurality of protective eyewear glasses 422 according to an embodiment of the invention. The interior retention mechanism 420 may be substantially triangular in shape along its length thereby allowing the arms of the protective eyewear glasses 422 to securely wrap around the interior retention mechanism 420. As shown in the figures, the interior retention mechanism 420 may in fact appear trapezoidal in shape with respect to the exterior box 412, although other shapes may be used, so long as they are conducive to retention of the protective eyewear glasses 422 within the exterior box 412. As a result, the protective eyewear glasses 422 may be loaded and presented to a user upside down, with the protruding frame element of the protective eyewear glasses 422 providing a convenient place to grasp and remove the protective eyewear glasses 422 without depositing fingerprints or contamination on the protective eyewear glasses 422 or their lenses. The interior retention mechanism 420 is sized to substantially secure against the exterior box 412 when the exterior box 412 receives the interior retention mechanism 420.

The interior retention mechanism 420 includes folding flaps 442 along its length, and along the apex area of the substantially triangular shape. The folding flaps 442 further allow guiding of the interior retention mechanism 420 into the exterior box 412, further provide securely holding the protective eyewear glasses 422 inside the exterior box 412, and further provide rigidity for the exterior box 412 once assembled.

Figure 20:
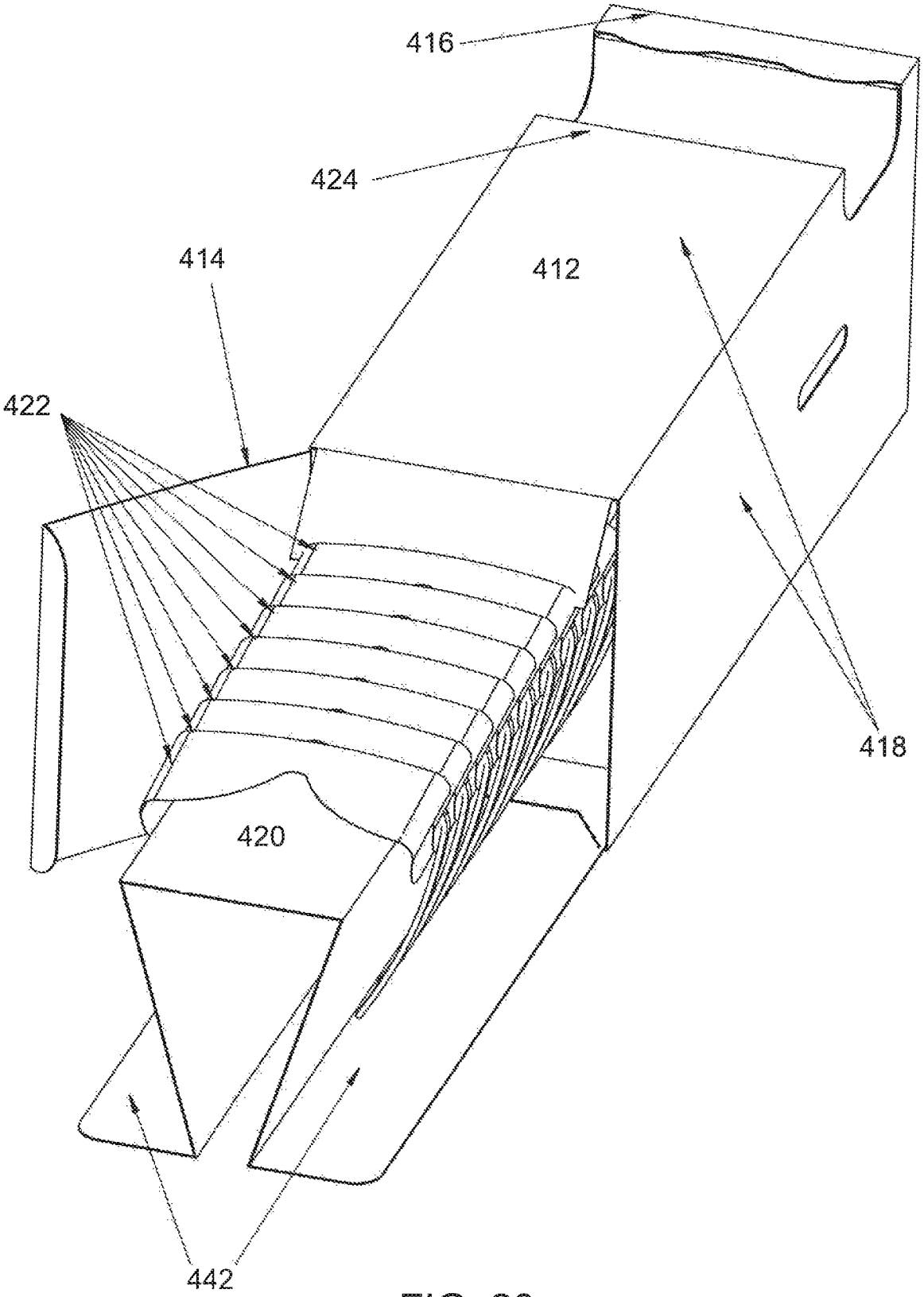
FIG. 20 is the exterior box of FIG. 11 receiving the interior retention mechanism of FIG. 19 for securely holding the plurality of protective eyewear glasses in place.
Figure 21:
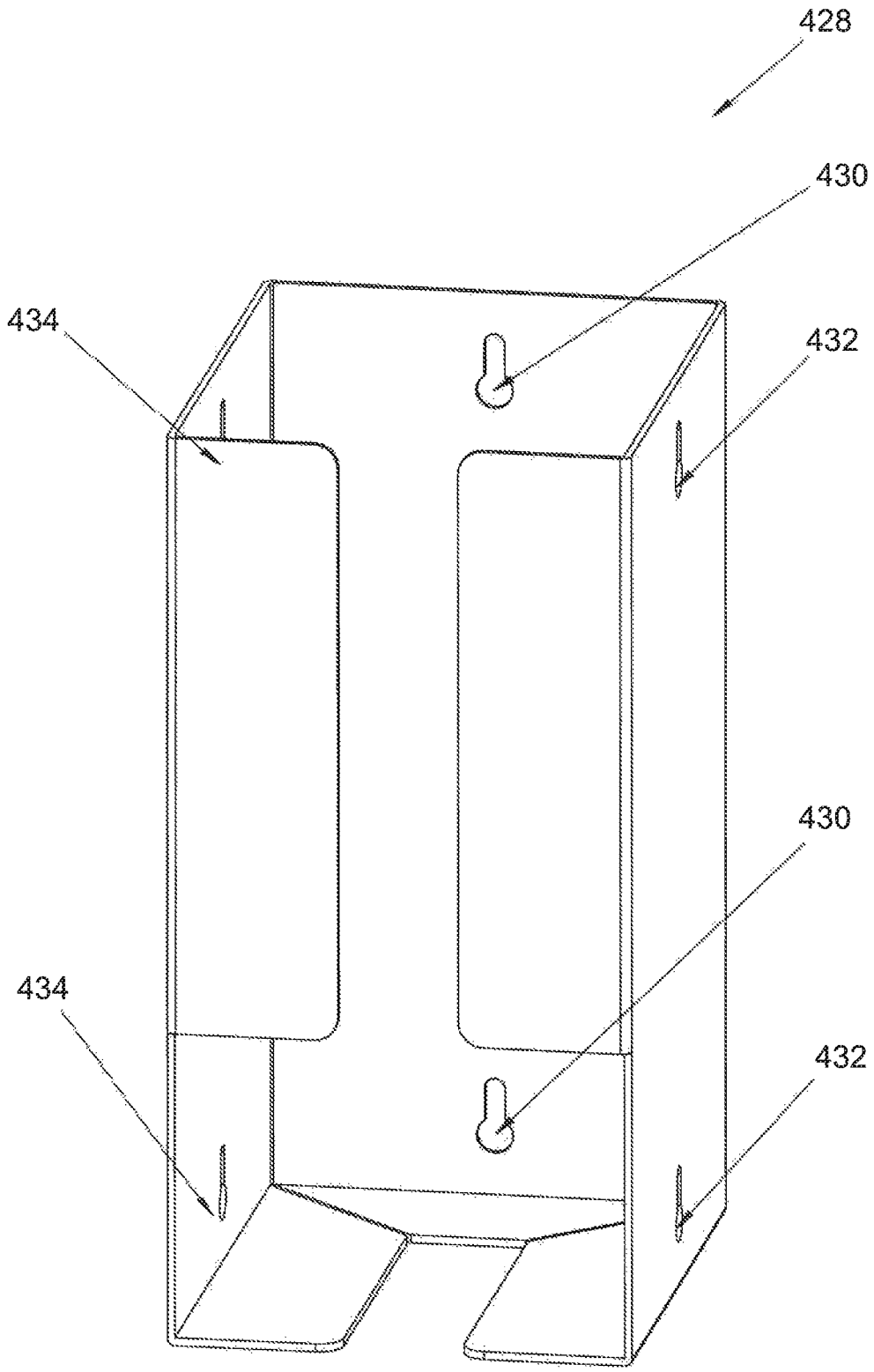
FIG. 21 is a front perspective view of the exterior enclosure for rigidly supporting the exterior box of FIG. 11.
Figure 22:
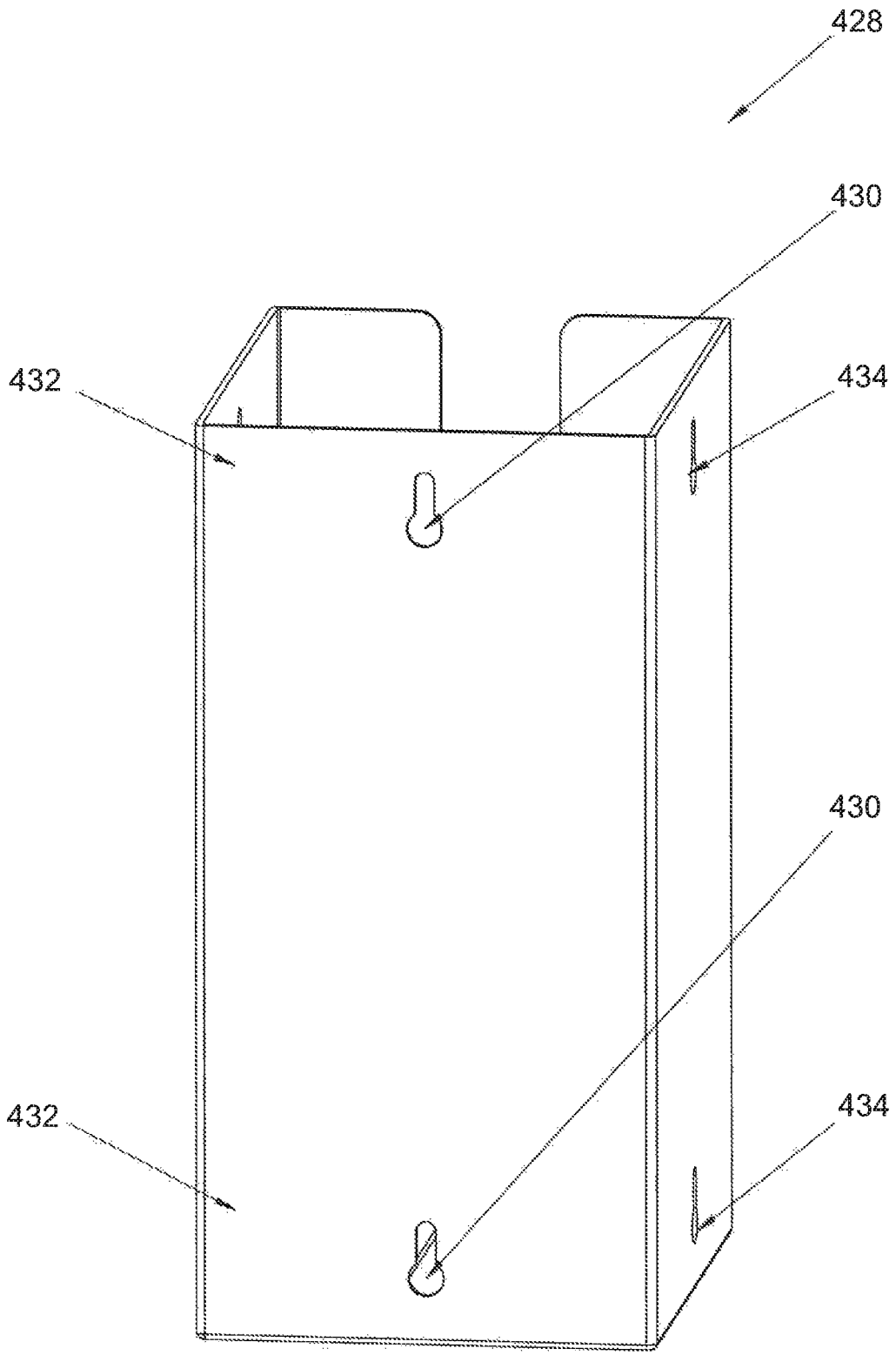
FIG. 22 is a rear perspective view of the exterior enclosure of FIG. 11.
Figure 23:
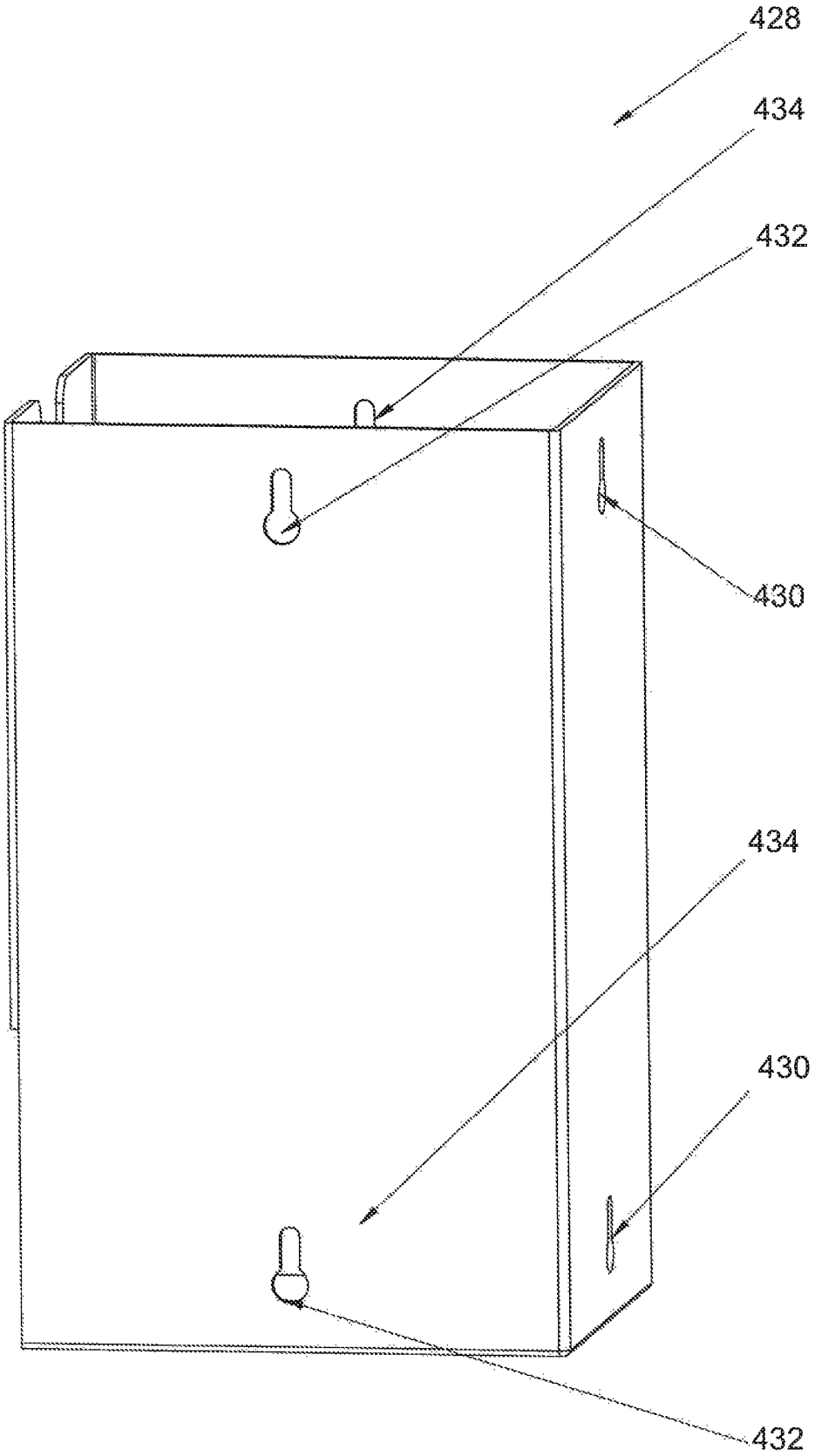
FIG. 23 is a left side perspective view of the exterior enclosure of FIG. 11.
Figure 24:
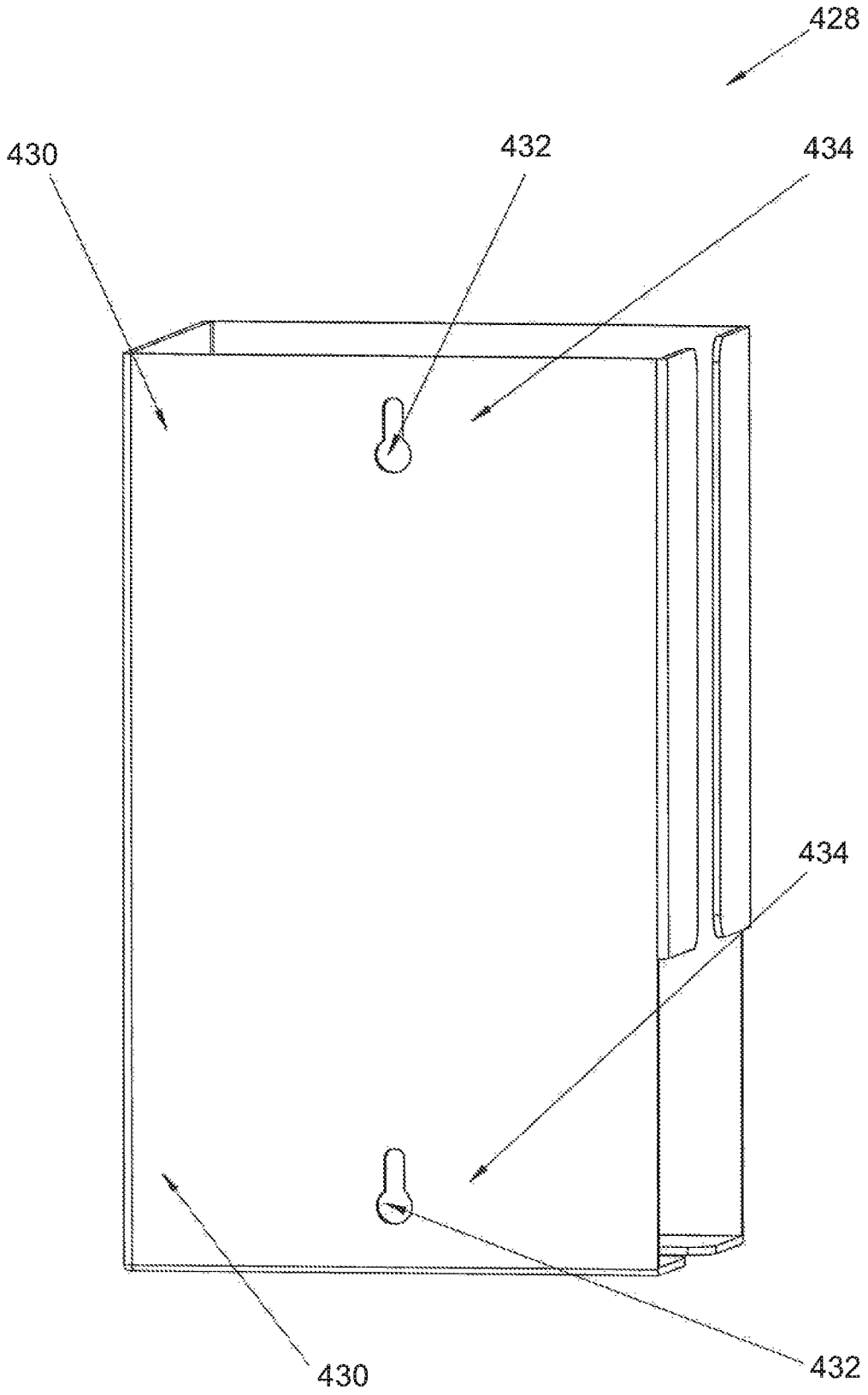
FIG. 24 is a right side perspective view of the exterior enclosure of FIG. 11.

Turning now to FIG. 20, the exterior box 412 completely receives the interior retention mechanism 420 for securely holding the plurality of protective eyewear glasses 422 in place. The interior retention mechanism 420 slides into the exterior box 412 through the top 414 of the exterior box 412.

Turning now to FIGS. 21-24, front, rear, left and right side perspective views of the exterior enclosure 428 of FIG. 11 are shown, respectively. The exterior enclosure 428 is a transparent plastic and provides rigid support for the exterior box 412. The rear of the exterior enclosure 428 includes the pair of mounting holes with grooves 430 for wall mounting. Similarly, the left side and the right side of the exterior box 412 also include the pairs of mounting holes with grooves 432 and 434, respectively, for wall mounting.

Finally, turning now to FIGS. 25 and 26, a bottom perspective view of the assembled dispenser-package 410 with bottom flaps closed, and a bottom perspective view of the assembled dispenser-package 410 with bottom flaps partially opened, are provided in accordance with an aspect of the invention.

The individual components need not be formed in the disclosed shapes, or assembled in the disclosed configuration, but could be provided in virtually any shape and assembled in virtually any configuration. Further, although various embodiments of eye protection, face shields, head bands, and dispensers are described herein with certain features, any of the features may be combined with or removed from any of the embodiments. Furthermore, all the disclosed features of each dispenser may be combined with, or substituted for, the disclosed features of every other embodiment.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

What is claimed is:

1. An eye shield dispenser comprising:

an exterior box having a top, a bottom and four sidewalls, wherein the exterior box has a first length;

an interior retention mechanism holding a plurality of protective eyewear glasses directly thereon, wherein:

the interior retention mechanism has a second length, wherein the first length of the exterior box is greater than the second length of the interior retention mechanism;

the exterior box completely receives the interior retention mechanism to hold the plurality of protective eyewear glasses in place;

the interior retention mechanism includes a plurality of folding flaps disposed along the second length of the interior retention mechanism, wherein:

the folding flaps secure the plurality of protective eyewear glasses inside the exterior box; and the folding flaps provide rigidity for the exterior box; and the exterior box includes a detachable area to allow accessing one or more of the protective eyewear glasses; and a spacer held within the exterior box, wherein:

the spacer is located between an end of the second length of the interior retention mechanism and a remaining portion of the first length of the exterior box; and the spacer positions the protective eyewear glasses such that only one pair of protective eyewear glasses may be dispensed at a time.

2. The dispenser of claim 1, wherein protective eyewear glasses wrap around the interior retention mechanism.

3. The dispenser of claim 1, wherein removal of a pair of protective eyewear glasses allows remaining protective eyewear glasses along the interior retention mechanism to slide with gravity when the exterior box is positioned upright.

4. The dispenser of claim 1, wherein the spacer further holds the interior retention mechanism in the exterior box.

5. The dispenser of claim 4, wherein the spacer held within the exterior box is in proximity to the bottom.

6. The dispenser of claim 1, further comprising an exterior enclosure for rigidly supporting the dispenser.

7. The dispenser of claim 6, wherein the exterior enclosure includes mounting holes for mounting the dispenser to a wall.

8. The dispenser of claim 1, wherein the interior retention mechanism holds at least twenty protective eyewear glasses along a second length.

9. The dispenser of claim 1, further comprising an opening in a sidewall of the exterior box for showing remaining protective eyewear glasses along the interior retention mechanism.

10. An eye shield dispenser for storing protective eyewear glasses, comprising:

an exterior box having a top, a bottom and four sidewalls along a first length, wherein the first length is greater than a width of the exterior box;

an interior retention mechanism holding a plurality of protective eyewear glasses, wherein:

the interior retention mechanism has a second length, wherein the first length of the exterior box is greater than the second length of the interior retention mechanism;

the exterior box completely receives the interior retention mechanism to hold the plurality of protective eyewear glasses in place;

the interior retention mechanism includes a plurality of folding flaps disposed along the second length of the interior retention mechanism, wherein:

the folding flaps secure the plurality of protective eyewear glasses; and the folding flaps provide rigidity for the exterior box;

a spacer held within the exterior box, wherein:

the spacer is located between the end of a second length of the interior retention mechanism and a remaining portion of the first length of the exterior box; and the spacer positions the protective eyewear glasses such that only one pair of protective eyewear glasses may be dispensed at a time;

an opening in a sidewall of the exterior box for showing remaining protective eyewear glasses along the second length; and a detachable area in the exterior box formed by perforations, wherein removal of the detachable area allows individually accessing the protective eyewear glasses.

11. The dispenser of claim 10, further comprising an exterior enclosure for rigidly supporting the exterior box, wherein the exterior enclosure includes mounting holes for mounting the dispenser to a wall, and wherein the interior retention mechanism holds at least 24 protective eyewear glasses along the second length.

12. A method for storing protective eyewear glasses, comprising:

holding a plurality of protective eyewear glasses in place along an interior retention mechanism, wherein:

the interior retention mechanism includes a plurality of folding flaps disposed along a length of the interior retention mechanism; and the plurality of protective eyewear glasses wrap around the plurality of folding flaps; and placing the interior retention mechanism completely in an exterior box having a top, a bottom and four sidewalls, wherein:

the folding flaps provide rigidity for the exterior box;

a spacer is held within the exterior box between an end of the interior retention mechanism and a remaining portion of the exterior box; and the exterior box includes a detachable area to allow accessing one or more of the protective eyewear glasses.

13. The method of claim 12, wherein protective eyewear glasses wrap around the interior retention mechanism on at least two sides of the interior retention mechanism.

14. The method of claim 12, wherein removal of a pair of protective eyewear glasses allows remaining protective eyewear glasses along the interior retention mechanism to slide with gravity when the exterior box is positioned upright.

15. The method of claim 12, wherein the spacer holds the interior retention mechanism in the exterior box.

16. The method of claim 15, wherein the spacer held within the exterior box is in proximity to the bottom.

17. The method of claim 12, further comprising rigidly supporting the dispenser with an exterior enclosure.

18. The method of claim 17, wherein the exterior enclosure includes mounting holes for mounting the dispenser to a wall.

19. The method of claim 12, wherein the interior retention mechanism holds at least 24 protective eyewear glasses.

20. The method of claim 12, wherein a sidewall of the exterior box includes an opening for showing remaining protective eyewear glasses along the interior retention mechanism.

* * * * *